United States Patent [19]

Kondo et al.

[11] 4,351,879

[45] Sep. 28, 1982

[54] POROUS ACRYLIC SYNTHETIC FIBERS COMPRISING CELLULOSE ACETATE IN AN ACRYLIC MATRIX

[75] Inventors: Yoshikazu Kondo; Toshihiro Yamamoto; Takaji Yamamoto, all of Hofu, Japan

[73] Assignees: Kanebo, Ltd., Tokyo; Kanebo Synthetic Fibers Ltd., Osaka, both of Japan

[21] Appl. No.: 156,993

[22] Filed: Jun. 6, 1980

[30] Foreign Application Priority Data

| | | | |
|---|---|---|---|
| Jun. 18, 1979 | [JP] | Japan | 54-77046 |
| Jun. 18, 1979 | [JP] | Japan | 54-77049 |
| Oct. 1, 1979 | [JP] | Japan | 54-127065 |
| Oct. 1, 1979 | [JP] | Japan | 54-127066 |

[51] Int. Cl.[3] ..... B32B 27/02; D01F 8/02; D01F 8/10; D02G 3/00

[52] U.S. Cl. ..... 428/374; 264/46.1; 264/177 F; 428/376; 428/398; 525/190; 521/134; 521/149

[58] Field of Search ..... 428/374, 376, 398; 525/190; 260/17 R

[56] References Cited

U.S. PATENT DOCUMENTS 4,012,346 3/1977 Makiyama et al. ..... 264/182

FOREIGN PATENT DOCUMENTS 39-14029 7/1964 Japan .
39-14030 7/1964 Japan .
42-6014 3/1967 Japan .
43-551 1/1968 Japan .
44-11969 5/1969 Japan .

OTHER PUBLICATIONS

*Chem. Abst.*, 78: 148816 (1973), 89: 130849 (1978), 91: 158915 (1979), 92: 23676 (1980), 94: 4881 (1981).

*Primary Examiner*—James C. Cannon
*Attorney, Agent, or Firm*—Blanchard, Flynn, Thiel, Boutell & Tanis

[57] ABSTRACT

Porous acrylic synthetic fibers having water absorption property and having substantially no microvoids but having mainly macrovoids are produced by spinning an organic solvent solution containing 15~35% by weight of a polymer consisting of 2~30 parts by weight of cellulose acetate and 70~98 parts by weight of an acrylic polymer into a coagulation bath at a temperature of no higher than 30° C., primarily drawing the spun fibers at a draw ratio of 2.5~8.0 times to form water swelled fibers wherein macrovoids are distributed, drying the water swelled fibers at a temperature of 100~180° C. to a water content of no greater than 1.0% by weight and secondarily drawing the dried fibers under wet heat to elongate the macrovoid structure.

This invention includes acrylic composite fibers having the water absorption property, wherein at least one of components A and B consisting of 2~50% by weight of cellulose acetate and 50~98% by weight of an acrylic polymer and another component B consisting of an acrylic polymer are bonded in a conjugate ratio of 2/8~8/2 (by weight) along the fiber axial direction, one component A having substantially no microvoids but having mainly macrovoids, and a method for producing said acrylic composite fibers.

31 Claims, 8 Drawing Figures

POROUS ACRYLIC SYNTHETIC FIBERS COMPRISING CELLULOSE ACETATE IN AN ACRYLIC MATRIX

The present invention relates to porous acrylic synthetic fibers and acrylic composite fibers having a water absorption property and methods for producing these fibers.

Natural fibers, such as cotton, wools, silks and others have a water absorption property of 20–40% and absorb perspiration satisfactorily so that a pleasant feeling is obtained during wearing, but synthetic fibers are low in the antistatic property and the hygroscopicity and have no water absorption property and perspiration absorption property and therefore the synthetic fibers are inferior to natural fibers in the commercial value. Particularly, if underwears, stockings, blankets, sports wears, etc. have no water- and perspiration-absorption property, the perspiration condenses on the fiber surface and such fibers are sticky and cause a cold feeling and are poor in regulation of the body temperature and an unpleasant feeling when wearing can not be avoided.

For improving the water- and perspiration-absorption property of synthetic fibers, various improvements have been heretofore proposed. The major parts of the improvements consist in the formation of microvoids in the fibers or the formation of unevenness on the fiber surface. For example, Japanese Patent Laid Open Application No. 25,418/72, Japanese Patent Nos. 665,549 and 702,476 and Japanese Patent Application Publication No. 6,650/73 have disclosed processes for producing porous acrylic fibers by selecting such a mild drying condition that microvoids remain in the swelled gel tow during the production of acrylic fibers. Furthermore, Japanese Patent Laid Open Application No. 25,416/72, Japanese Patent Application Publication Nos. 8,285/73 and 8,286/73 have disclosed that a water soluble compound is incorporated in the swelled gel tow during the production of acrylic fibers and the swelled gel tow is dried and after-treated, after which the water soluble compound is dissolved off to reform the voids. The common concept in the above described processes consists in that microvoids inherently formed during the production of the acrylic fibers are maintained in the final product to obtain porous acrylic fibers. The microvoids formed in the swelled gel tow are very thermally unstable. Therefore, it is impossible to effect treatment at a high temperature in the steps for producing the fibers, particularly at the drying, shrinking and crimp setting steps and the heat resistance, form stability and crimp stability of the final product are poor and the commercial value of the product is considerably deteriorated. The radius of the voids in the obtained product is very small, such as 10–1,000 Å. Since numerous microvoids are uniformly distributed in the fibers, the strength and elongation of the fibers are low, the luster is poor and the dyed color is not clear. Furthermore, since numerous microvoids are uniformly distributed, the heat resistance of the fibers is low and in a high temperature dyeing, steaming treatment, pressing treatment and the like, the voids are eliminated, the water absorption property is deteriorated, the color tone is varied, the form stability is deteriorated and the qualities are degraded.

When it is attempted to develop the water absorption property by these voids, the microvoids are apt to be formed as closed voids and they hardly form passages through which water is absorbed into the fibers and this proposal is not effective. In order to obtain a certain degree of water absorption property, a fairly large number of microvoids are necessary and this further deteriorates the fiber properties and commercial value. It has been previously attempted to improve the feel and the dyeability by mix-spinning of cellulose acetate-acrylic polymer or cellulose acetate-modacrylic copolymer. For example, Japanese Pat. Nos. 222,873 and 243,556 and Japanese Patent Application Publication No. 14,029/64 have disclosed that the spinning solution obtained by mixing cellulose acetate with acrylic polymer or modacrylic copolymer is spun to obtain fibers having improved dyeability and feel. The fibers obtained in these processes are dense and have no water absorption property due to voids in the fiber interior. In addition, Japanese Pat. No. 433,941 has disclosed that cellulose acetate is added during polymerization of the acrylic polymer as a means for mixing cellulose acetate, but when the polymer obtained by mixing cellulose acetate during polymerization of the acrylic polymer is used, the heat resistance of the spun fibers is deteriorated owing to the degradation of cellulose acetate and troubles occur during the steps for producing the fibers and the product having the satisfactory quality can not be obtained. Japanese Pat. No. 556,549 and Japanese Patent Laid Open Application Nos. 118,027/75 and 118,026/75 have described that cellulose acetate or a mixture of cellulose acetate and titanium oxide and the like is finely distributed in acrylic polymer or modacrylic polymer to obtain animal hair-like fibers but it can not provide porous fibers having a high water absorption property as is obtained in the present invention. German Patent Laid Open Application No. 2,901,778 has proposed acrylic fibers having a water absorption property, consisting of a porous core portion having a large number of microvoids and macrovoids and a skin portion having a high density, but these fibers have a large number of microvoids, so that the yarn property and dyeability are deteriorated. Further it is not easy to produce fibers having uniform microvoids and it is difficult to obtain fibers having stable quality. Fibers having excellent yarn property, heat resistance, dyeability and water absorption property as in the present invention can not be obtained by this procedure.

From the above described reasons, porous acrylic synthetic fibers having improved water absorption property, heat resistance, dyeability and luster can not be obtained by the prior presence.

Japanese Patent Application Publication No. 6,014/67 has disclosed acrylic composite fibers obtained by conjugate spinning acrylic polymers having different contents of ionic hydrophilic groups in which as a composite component having a smaller amount of said hydrophilic group, use is made of an acrylic polymer containing a cellulosic polymer which is obtained by solution polymerization of acrylic monomer in the presence of a cellulosic polymer soluble in a solvent for polymerization of the acrylic polymer. Japanese Pat. No. 520,657 has disclosed that in the conjugate spinning of acrylonitrile polymer containing an acidic group and acrylonitrile polymer containing a basic group, a cellulosic polymer is contained in a component having a lower shrinkage among these polymers. However, these processes aim to improve the crimpability and dyeability and to provide the resilient feeling of the cellulosic polymer but do not aim at porous acrylic composite fibers having a water absorption property and these fibers can not be obtained by these processes. The inventors have diligently studied to obviate the prior defects and accomplished the present invention.

An object of the present invention is to provide porous acrylic synthetic fibers and acrylic composite fibers having excellent water absorption property and good yarn properties.

Another object of the present invention is to provide methods for producing porous acrylic synthetic fibers and acrylic composite fibers having excellent water absorption property and good yarn properties commercially easily and cheaply.

The present invention consists in porous acrylic synthetic fibers having substantially no microvoids but having mainly macrovoids, which consist of 2~30% by weight of cellulose acetate and 70~98% by weight of an acrylic polymer and have a surface area A of voids of no greater than 15 $m^2/g$ and a porosity V of 0.05~0.75 $cm^3/g$, V/A being 1/30 or more.

The process of the present invention comprises spinning an organic solvent solution containing 15~35% by weight of a polymer consisting of 2~30 parts by weight of cellulose acetate and 70~98 parts by weight of an acrylic polymer into a coagulation bath at a temperature of no higher than 30° C. to obtain fibers wherein the formation of microvoids is restrained, effecting primary drawing of the spun fibers at a draw ratio of 2.5~8 times, drying the fibers in a water swelled state having distributed macrovoids at a temperature of 100°~180° C. to a water content of no greater than 1.0% by weight to substantially eliminate microvoids and effecting secondary drawing of the dried fibers under wet heat at a draw ratio of no greater than 3 times to promote the macrovoid structure.

Furthermore, the present invention relates to acrylic composite fibers and a method for producing said fibers, which is discussed later.

The acrylic synthetic fibers according to the present invention consist of 2~30% by weight, preferably 3~25% by weight, more preferably 6~20% by weight, more particularly from more than 10% by weight to 18% by weight of cellulose acetate and 70~98% by weight, preferably 75~97% by weight, more preferably 80~94% by weight, more particularly from 82% by weight to less than 90% by weight of an acrylic polymer. When the amount of cellulose acetate distributed in the fibers is less than 2% by weight, phase separation thereof from the acrylic polymer is insufficient and the satisfactory water absorption property can not be obtained, while when said amount exceeds 30% by weight, the phase separation becomes excessive and the strength and elongation, dyeability and luster of the fibers are deteriorated, so that these amounts should be avoided.

Cellulose acetate to be used in the present invention is not particularly limited but in general, is one having a combined acetic acid of 48~63% and an average polymerization degree of 50~300.

The acrylic polymers to be used in the present invention contain at least 80% by weight, preferably 85~93% by weight of acrylonitrile and may contain less than 20% by weight of copolymerizable monomers, for example alkyl acrylates or methacrylates, such as methyl acrylate, methyl methacrylate, ethyl acrylate, amides, such as acrylamide, methacrylamide, N-monosubstituted or N,N-disubstituted amides thereof, vinyl acetate, sulfonic acid group-containing monomers, such as styrenesulfonic acid, allylsulfonic acid, methallylsulfonic acid and the salts thereof. In particular, when 0.3~1.5% by weight, preferably 0.5~1.2% by weight of allylsulfonic acid or methallylsulfonic acid or the salts thereof is copolymerized, the dyeability is not only improved, but also the formation of numerous microvoids is prevented, whereby the degradation of the heat resistance is prevented and porous fibers having macrovoids and excellent water absorption property can be obtained.

The acrylic polymer of the acrylic synthetic fibers according to the present invention may contain an acrylic copolymer containing 5~30% by weight of a monomer having the general formula $$CH_2{=}\overset{\overset{R_1}{|}}{C}{-}COOX$$

wherein X is $R_2$ or $$\text{-}(CH_2{-}CH_2{-}O)_l(CH_2{-}\overset{\overset{CH_3}{|}}{CH}{-}O)_m{-}R_3,$$

$R_1$ and $R_3$ are H or $CH_3$, $R_2$ is H, $NH_4$ or an alkali metal, and l and m are an integer of 0~50 and $0<l+m\leqq 50$, and the acrylic copolymer is no greater than about 33% by weight based on the total polymer composing the acrylic synthetic fibers. By incorporating the above described acrylic copolymer in the acrylic synthetic fibers, the dispersability of cellulose acetate is improved. As the monomers to be copolymerized in the acrylic copolymers shown by the above described general formula, acrylic acid, methacrylic acid and $$CH_2{=}\overset{\overset{R_1}{|}}{C}{-}COO\text{-}(CH_2{\cdot}CH_2{-}O)_l(CH_2\overset{\overset{CH_3}{|}}{CH}{-}O)_m{-}R_3$$

are preferable in view of the polymerizability, discoloration and resistance to water solubility. As the length of the ethylene glycol chain or the propylene glycol chain contained in these monomers is larger, the hydrophilic property of the acrylic copolymer is increased and the content is permitted to be smaller, but when l+m exceeds 50, the polymerizability and solubility of the acrylic copolymer are degraded. As the monomers copolymerizable in the acrylic copolymer other than the monomers having the above described general formula, the above described monomers to be used in the polymerization of the acrylic polymers may be used. The acrylic copolymer contains at least 70% by weight of acrylonitrile.

The acrylic synthetic fibers according to the present invention have substantially no microvoids but have mainly macrovoids and the macrovoids contribute to the water absorption property. In the acrylic synthetic fibers according to the present invention, cellulose acetate is distributed in an elongated form having the longest dimension parallel to the fiber axis and generally has voids in the circumference and the inner portion of cellulose acetate and the ratio of the length to the diameter of the elongated cellulose acetate is generally 10 or more. The voids present in the distributed elongated cellulose acetate are macrovoids caused by the phase separation of cellulose acetate and acrylic polymer and are further elongated by the secondary drawing. The acrylic polymer component in the acrylic synthetic fibers of the present invention has substantially the same degree of denseness as usual acrylic synthetic fibers and has substantially no microvoids. The term "substantially no microvoids" used herein means that the ratio (by volume) of microvoids occupied in the porosity (V) of the fibers is not greater than 30%, preferably not greater than 25%, more preferably not greater than 20%, more particularly not greater than 15%. The term "microvoid" used herein means voids having a diameter of less than 2,000 Å.

The water absorption property of the acrylic synthetic fibers according to the present invention can be obtained owing to these macrovoids and the ratio of the macrovoids occupied in the porosity is at least 70%, preferably at least 75%, more preferably at least 80%, more particularly at least 85%. Cellulose acetate is distributed not only in the inner portion of the cross section of the fiber but also in the fiber wall, so that macrovoids are observed at the fiber surface. The high water absorption property of the acrylic synthetic fibers of the present invention is presumably due to the fact that the voids opening at the fiber surface communicate with the macrovoids in the inner portion of the fibers.

Then, the acrylic synthetic fibers according to the present invention will be explained with reference to the accompanying drawings, wherein.

Figure 7:
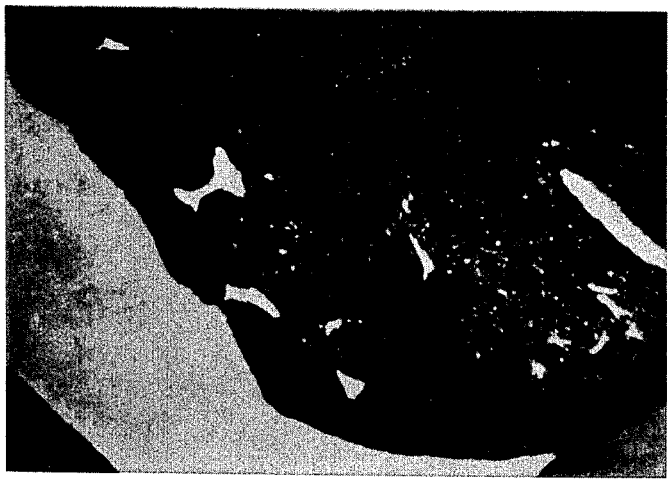
Figure 8:
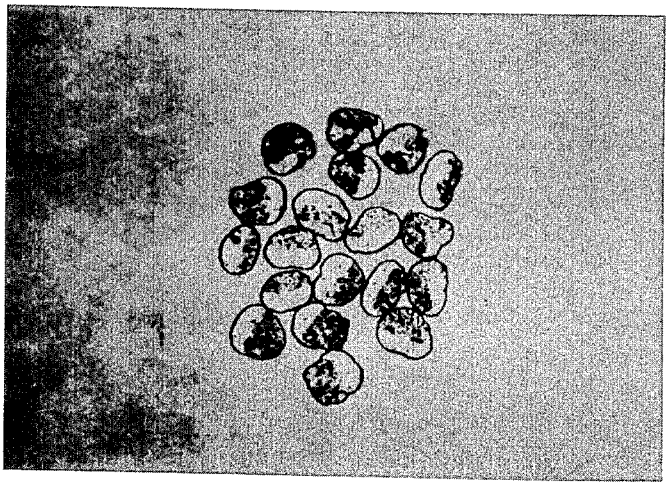

FIG. 7 is an electron micrograph (magnification: 12,000 times) of the cross section of conventional acrylic fiber having microvoids, and FIG. 8 is an optical photomicrograph (magnification: 200 times) of the cross section of acrylic composite fibers of the present invention wherein an acrylic polymer (component A) containing cellulose acetate and an acrylic polymer (component B) are bonded in side-by-side relation.

Figure 2:
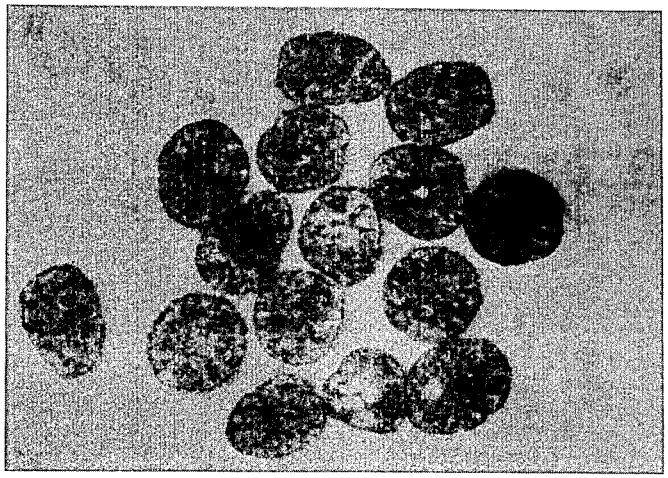
FIG. 2 is an optical photomicrograph (magnification: 200 times) of the cross section of porous acrylic fibers having a water absorption property, which contain cellulose acetate and in which a large number of microvoids are formed together with macrovoids.
Figure 3:
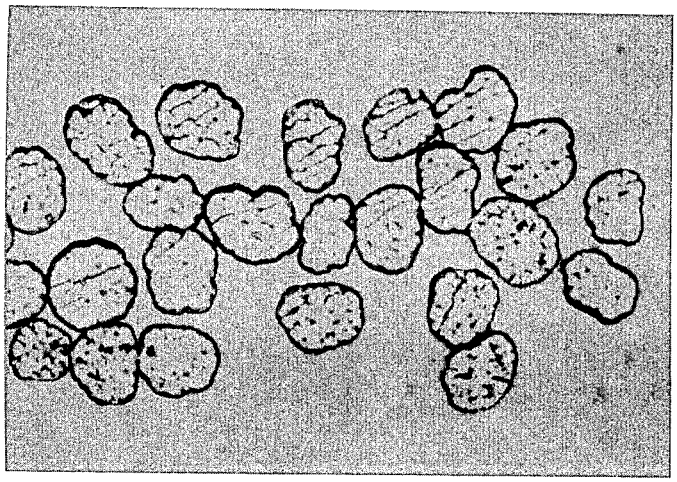
FIG. 3 is an optical photomicrograph (magnification: 200 times) of the cross section of porous acrylic fibers of the present invention.

In FIG. 2 and FIG. 3, fibers in which red dye stuff was impregnated so that the judgement of the presence of microvoids was made easy, were used as the samples.

Figure 1:
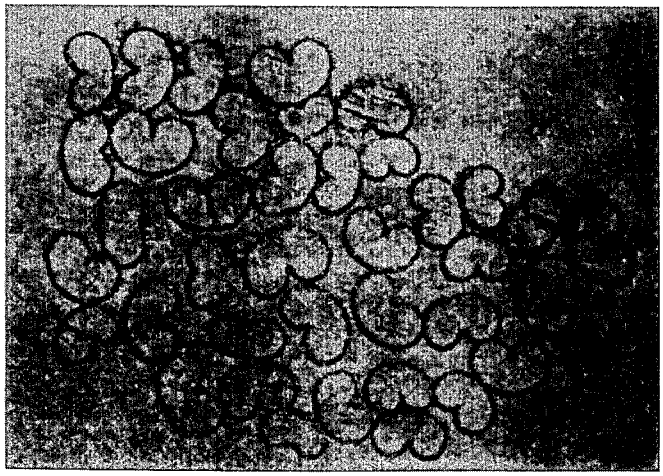
FIG. 1 is an optical photomicrograph (magnification: 200 times) of the cross-section of conventional acrylic fibers.

As seen from FIG. 1, the usual acrylic fiber does not substantially have voids. In FIG. 2, since macrovoids are observed but the fibers have numerous microvoids, the dye stuff penetrates along the entire cross section of the fibers. In the fibers according to the present invention, as seen from FIG. 3, only macrovoids are observed and microvoids are not substantially observed.

Figure 4:
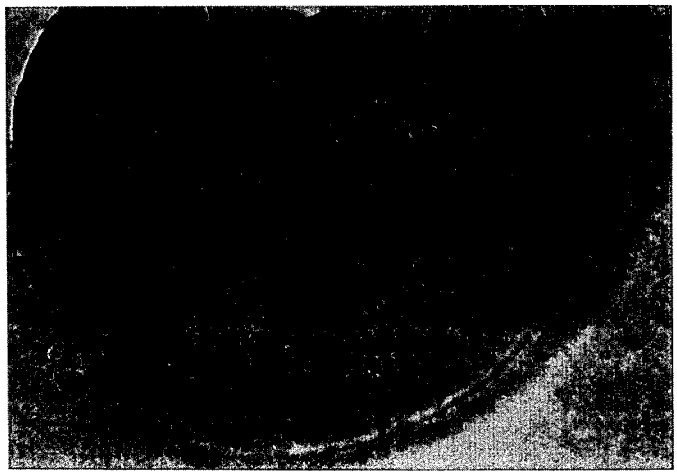
FIGS. 4, 5 and 6 are electron micrographs (magnification: 12,000 times) of the cross sections of the fibers shown in FIGS. 1~3 respectively.
Figure 5:
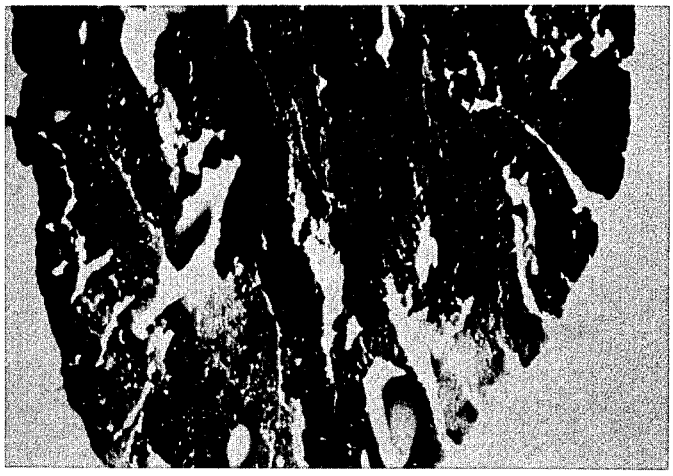
Figure 6:
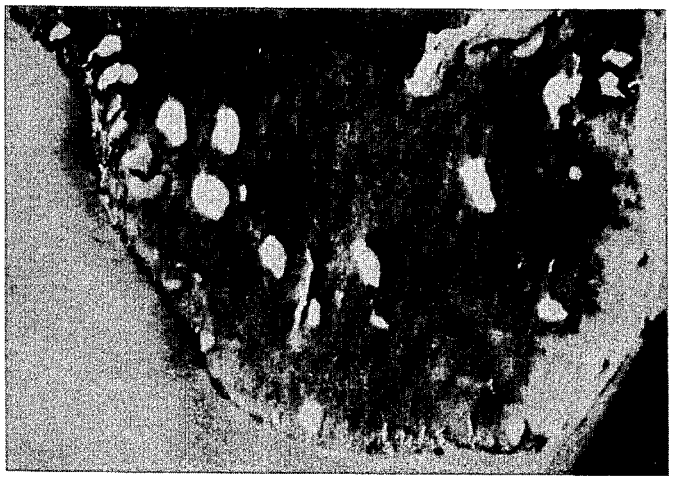

The usual acrylic fiber in FIG. 4 is very dense and no microvoids are observed. FIG. 5 shows apparently that a large number of microvoids are present in the inner portion of the fiber. On the other hand, FIG. 6 shows that the fiber of the present invention has substantially the same density as the usual acrylic fiber at the portion other than macrovoids. The microvoid structure is apparently observed from FIG. 7 in the conventional acrylic fiber having the microvoid structure.

In the acrylic synthetic fibers of the present invention the surface area A of voids is no greater than 15 $m^2/g$, preferably 0.02~10 $m^2/g$, a porosity V is 0.05~0.75 $cm^3/g$, preferably 0.05~0.60 $cm^3/g$ and V/A is 1/30 or more, preferably 1/20 or more.

The surface area A($m^2/g$) of voids in the fibers was determined as follows. Nitrogen gas was adsorbed in the fibers at the temperature of liquid nitrogen, the total surface area of the fibers was determined by the BET equation and from this value was subtracted the surface area of the outer skin of the fibers. The amount of the fibers to be measured was adjusted so that the value of the total surface area to be measured is 1 $m^2$ or more.

The porosity V($cm^3/g$) was determined as follows. A density $\rho$($g/cm^3$) of a film prepared so as to have the same composition as the fiber and a high density, was measured and an average cross sectional area of the fibers containing the voids was determined by photographic process and referred to as S($cm^2$) and an actual average cross sectional area So($cm^2$) of the fibers at the portion containing no voids was determined from the following equation (1) and the porosity V was determined from the following equation (2).

$$So = \frac{De}{900000 \times \rho} \quad (1)$$

$$V = \frac{1}{\rho} \times \frac{S - So}{So} \quad (2)$$

*De*: Denier

The ratio of microvoids occupied in the porosity was calculated by measuring the microvoid content by means of a mercury porosimeter. Firstly, the fibers are opened and weighed and then filled in a cell of a mercury porosimeter and a pressure and an amount of mercury pressed in are recorded while pressing mercury at room temperature. Between a diameter D($\mu$) of the voids and a pressure P(psi) necessary for filling mercury in the voids, there is a relation shown by the following formula $$D = 175/P$$

By measuring P and the amount of mercury pressed in the diameter D($\mu$) and the volume ($cm^3/g$) of the voids are determined. From these data, a void distribution curve is obtained and an amount of the voids in which D is 0.2$\mu$ or less is determined, which is referred to as the microvoid content ($cm^3/g$) in 1 g of the fibers.

When the porosity V is less than 0.05 $cm^3/g$, the water absorption property is not satisfied, while when the porosity V exceeds 0.75 $cm^3/g$, the strength and elongation of the fibers are degraded and the luster and dyeability are adversely affected, so that these values should be avoided.

When the surface area A of the voids exceeds 15 $m^2/g$, the microvoids in the fibers increase and the strength and elongation are not only deteriorated but also the dyeability and heat resistance are deteriorated. When V/A is less than 1/30, the water absorption property is not satisfied or the heat resistance, dyeability and the like as well as the strength and elongation are deteriorated. Furthermore, it has been found from the experimental data of the inventors that when V/A is less than 1/30, the voids in the fibers become small and if the size is calculated into, for example a sphere, the diameter becomes less than 2,000 Å and the excellent water absorption property can not be obtained and the strength and elongation are deteriorated.

The acrylic synthetic fibers according to the present invention are produced by spinning an organic solvent solution containing 15~35% by weight, preferably 17~30% by weight of a polymer consisting of 2~30 parts by weight, preferably 3~25 parts by weight, more preferably 6~20 parts by weight, more particularly from more than 10 parts by weight to 18 parts by weight of cellulose acetate, and 70~98 parts by weight, preferably 75~97 parts by weight, more preferably 80~94 parts by weight, more particularly 82~90 parts by weight of an acrylic polymer or a blend of an acrylic polymer and an acrylic copolymer into a coagulation bath at a temperature of no higher than 30° C. When the amounts of cellulose acetate, an acrylic polymer or a blend of an acrylic polymer and an acrylic copolymer are beyond these ranges, acrylic synthetic fibers having an excellent water absorption property and yarn properties can not be obtained. When the concentration of the polymer is less than 15% by weight, the production cost becomes higher and the formation of microvoids increases to deteriorate the strength and elongation. While when the concentration exceeds 35% by weight, the viscosity increases, whereby the operability and spinnability are deteriorated and further the yarn properties are degraded, so that these amounts should be avoided.

As the organic solvent to be used in the present invention, mention may be made of common solvents for cellulose acetate, acrylic polymers and acrylic copolymers but in general, organic solvents, such as dimethylformamide, dimethylacetamide, dimethylsulfoxide, ethylene carbonate and the like are preferable in view of the recovery and purification of the solvents. As the coagulation bath, use may be made of an aqueous solution of an organic solvent, such as dimethylformamide, dimethylacetamide, dimethylsulfoxide, ethylene carbonate and the like, and organic solvents, such as propyl alcohol, kerosene and the like, but an aqueous solution of an organic solvent to be used for dissolving the polymer is particularly preferable.

The process for mixing cellulose acetate and an acrylic polymer or mixing an acrylic copolymer to said mixture is not particularly limited. For example, each of the polymers is dissolved in a common solvent and the obtained solutions are mixed or these polymers are concurrently added and dissolved in a common solvent.

Water may be added to the spinning solution within the range which does not cause gellation of the spinning solution. This addition of water is effective for controlling the viscosity of the spinning solution and preventing the formation of microvoids in the spun fibers. Interestingly, the inventors have found that the dispersed state of the elongated cellulose acetate in the spun fibers varies depending upon the water content in the spinning solution. Namely, when the water content in the spinning solution is increased, the dispersed state of the elongated cellulose acetate becomes longer, conversely as the water content decreases, the form becomes spherical. A similar result is obtained depending upon the variation of the viscosity of the spinning solution.

The spinning can be carried out under the same conditions as are employed for preparing conventional acrylic synthetic fibers except that the temperature of the coagulation bath cannot be higher than 30° C. Several stages of spinning baths are used and the primary drawing and water washing are carried out. The primary draw ratio is 2.5~8 times, preferably 3~6 times. When the primary draw ratio is less than 2.5 times, the drawing and orientation of the fibers are insufficient and therefore the strength is low and cracks are formed in the fibers and such a drawing should be avoided. While, when the draw ratio exceeds 8 times, the densification excessively proceeds and a satisfactory water absorption property can not be obtained and the operability is deteriorated, so that such draw ratios should be avoided.

The spinning draft ratio may be the usual condition, but for restraining the formation of microvoids a lower draft ratio is preferable. The temperature of the coagulation bath for restraining the formation of microvoids must be not higher than 30° C., preferably not higher than 25° C., more preferably not higher than 20° C. When the temperature of the coagulation bath is higher than 30° C., a large number of microvoids are formed and the yarn properties and quantity of the obtained fibers are considerably deteriorated.

In the primary drawn fibers, the dispersion of the elongated cellulose acetate, and the voids formed by the phase separation of cellulose acetate and the acrylic polymer become more distinct. But the fibers contain a large number of microvoids inherently contained in the usual swelled gel tow. These microvoids are not desirable because of the deterioration of the heat resistance, dyeability and luster of the fibers. Hence, the fibers wherein the microvoids and macrovoids coexist, are dried to eliminate the microvoids but, in this case, the drying is carried out at a temperature of 100°~180° C., preferably 105°~150° C. until the water content becomes no greater than 1.0% by weight, whereby only the microvoids are eliminated and the macrovoids formed due to the phase separation are maintained. When the drying temperature is lower than 100° C., the microvoids formed in the acrylic polymer can not be completely collapsed by drying and the strength and elongation, luster, dyeability and heat resistance of the fibers are deteriorated. While when the drying temperature exceeds 180° C., the fibers are hardened and discolored, so that such a temperature should be avoided. For drying, it is desirable for eliminating the microvoids to use a hot roller type dryer in which the fibers are brought into contact with a metal surface heated at a high temperature. In addition, if the drying is effected by blowing hot air at a temperature of 120°~170° C. as a supplemental means, the drying can be effected more uniformly, so that such a means is desirable. The water content of the dried fibers must be no greater than 1.0%. When the water content exceeds 1.0%, the uneven drying of the fibers occurs and a large number of microvoids partially remain resulting in unevenness of dyeing, luster and strength of the fibers and the uniformity of quality is deteriorated. In this drying step, a torque motor may be used to effect shrinkage of 5~15% together with the drying.

The dried fibers should be subjected to a secondary drawing under wet heat to a draw ratio of no greater than 3 times, preferably 1.05~2 times in order to make the phase separation of the acrylic polymer and cellulose acetate in the fibers more distinct and to promote the macrovoid structure and improve the water absorption property and provide moderate physical properties of the fiber. The secondary drawing includes stretching shrinkage of substantial draw ratio of no greater than 1.0. But in order to elongate the macrovoid structure, the draw ratio is preferred to be at least 1.05, particularly at least 1.1. When the draw ratio exceeds 3 times, yarn breakage occurs and if the temperature is raised in order to prevent yarn breakage, stickiness of the fibers occurs and the water absorption property is considerably deteriorated. After the secondary drawing, the fibers are subjected to after-treating steps for imparting good spinnability and performance to the fibers, such as wet heat shrinking step, oiling step, crimping step and crimp-setting step to obtain the final product.

Now, an explanation will be made with respect to acrylic composite fibers according to the present invention. The composite fibers according to the present invention are ones having a water absorption property obtained by bonding a component A consisting of 2~50% by weight of cellulose acetate and 50~98% by weight of an acrylic polymer and a component B consisting of an acrylic polymer in a weight ratio of 2/8~8/2 along the fiber axial direction, the component A having substantially no microvoids but having mainly macrovoids, and having a porosity of the entire fibers of 0.05~0.75 $cm^3/g$ and a surface area of voids of no greater than 15 $m^2/g$, or ones having a water absorption property and latent crimpability obtained by eccentrically bonding two components A and B consisting of 2~50% by weight of cellulose acetate and 50~98% by weight of an acrylic polymer, a plasticizing component in the acrylic polymer in both the components A and B having a difference of at least 2% by weight, in a weight ratio of 7/3~3/7, a total amount of cellulose acetate in the fibers being 2~30% by weight, having substantially no microvoids but having macrovoids, and having a porosity of 0.05~0.75 $cm^3/g$ and a surface area of voids of no greater than 15 $m^2/g$.

The process for producing the composite fibers according to the present invention comprises conjugate spinning two organic solvent solutions A and B in which at least one solution contains a polymer consisting of 2~50% by weight of cellulose acetate and 50~98% by weight of an acrylic polymer, into a coagulation bath at a temperature of no higher than 30° C. through common spinning orifices to form composite fibers in which the formation of microvoids is restrained, effecting primary drawing the spun fibers in a draw ratio of 2.5~8 times, drying the water swelled fibers containing distributed macrovoids at a temperature of 100°~180° C. to a water content of no greater than 1.0% by weight to substantially eliminate microvoids and then effecting secondary drawing of the dried fibers in a draw ratio of no greater than 3 times under wet heat to promote the macrovoid structure.

In the case of acrylic composite fibers in which only the component A contains cellulose acetate, when an amount of a plasticizing component in acrylic polymers composing the components A and B, such as methyl acrylate, methyl methacrylate, ethyl acrylate, ethyl methacrylate, acrylamide, vinyl acetate, 2-hydroxyethyl acrylate, 2-hydroxyethyl methacrylate and the like is different in an amount of at least 2% by weight and the component A and the component B are conjugate spun eccentrically, composite fibers having latent crimpability can be obtained. On the other hand, when there is substantially no difference in the content of the above described plasticizing component in the acrylic polymers to composing the component A and the component B or both the components are concentrically conjugate spun, composite fibers having substantially no latent crimpability can be obtained.

The component A and the component B are bonded in a conjugate ratio of 2/8~8/2, preferably 3/7~7/3, more preferably 4/6~6/4. If the component A is smaller than 2/8 in the conjugate ratio, a satisfactory water absorption property can not be given to the composite fibers, while if the component A exceeds 8/2, the luster and color brightness after dyeing are deteriorated. As the plasticizing components in both the components A and B to be used in the acrylic composite fibers containing cellulose acetate, mention may be made of the above described compounds. The difference of the content of the plasticizing in both the components is at least 2% by weight, preferably 2.5~5% by weight. The components A and B are bonded eccentrically, preferably in side-by-side relation.

When the difference of the content of the above described plasticizing component is less than 2% by weight, it is impossible to obtain composite fibers having substantial the latent crimpability. The component A and the component B are bonded in a conjugate ratio of 3/7~7/3, preferably 4/6~6/4. When the ratio exceeds this range, composite fibers having excellent crimpability can not be obtained. The conjugate ratio of the acrylic composite fibers according to the present invention can be conveniently varied by varying the extruded amount of the solutions of the components A and B in an organic solvent or the polymer concentration.

When the component A or both the components A and B contain cellulose acetate, the amount of cellulose acetate is 2~50% by weight, preferably 3~40% by weight, more preferably 5~30% by weight. When the amount of cellulose acetate distributed in the component A or both the components A and B is less than 2% by weight, the phase separation of the acrylic polymer is insufficient and the water absorption property can not be satisfied, while when said amount exceeds 50% by weight, the strength and elongation in the component A or both the components A and B become considerably lower and both the components are disengaged, so that these amounts should be avoided.

When cellulose acetate in contained in both the components A and B, the total amount of cellulose acetate contained in both the components A and B is 2~30% by weight, preferably 2~25% by weight, more preferably 3~20% by weight. When the total amount is less than 2% by weight, the water absorption property is not satisfied and when said amount exceeds 30% by weight, the yarn properties, such as strength and elongation of the composite fibers are deteriorated and these amounts should be avoided.

Concerning the acrylic polymers, acrylic copolymers and cellulose acetate to be used for the acrylic composite fibers according to the present invention, the above described explanation concerning the acrylic synthetic fibers can be applied.

Cellulose acetate in at least one component of the composite fibers of the present invention is distributed in an elongated form parallel to the fiber axis, and generally has voids around the elongated cellulose acetate and in the inner portion and the ratio of the length of the distributed elongated cellulose acetate to the diameter thereof is usually 10 or more.

The component containing cellulose acetate in the composite fibers of the present invention does not substantially have microvoids but has mainly macrovoids and these macrovoids contribute to the water absorption property.

FIG. 8 is an optical photomicrograph (magnification: 200 times) of the cross section of the acrylic composite fibers of the present invention in which the component A (acrylic polymer containing cellulose acetate) and the component B (acrylic polymer) are bonded in side-by-side relation and it can be seen from FIG. 8 that macrovoids are observed in the component A and the component B is dense.

The acrylic composite fibers of the present invention have a porosity of 0.05~0.75 $cm^3/g$, preferably 0.05~0.60 $cm^3/g$ and a surface area of voids of no greater than 15 $m^2/g$, preferably 0.02~10 $m^2/g$ as the entire fibers.

When the porosity is less than 0.05 $cm^3/g$, the water absorption property is not satisfactory, while when the porosity exceeds 0.75 $cm^3/g$, the strength and elongation of the fibers not only are deteriorated, but also the luster and dyeability are adversely affected.

When the surface area of the voids exceeds 15 $m^2/g$, microvoids increase in the fibers and the strength and elongation decrease and the dyeability and heat resistance are deteriorated.

The organic solvent, coagulation bath condition, and spinning and drawing conditions in the production of the acrylic composite fibers are similar to those in the above described production of acrylic synthetic fibers.

After the secondary drawing, the composite fibers having the latent crimpability may be subjected to after-treatments, such as shrinkage-drawing-shrinking in order to enhance the crimpability. After the secondary drawing, the fibers are subjected to after-treatments for giving high spinnability and properties, such as shrinking under wet heat, oiling, crimping, crimp setting and the like, to obtain the final product.

The composite fibers of the present invention can easily develop crimps through hot water treatment and steam treatment.

The porous acrylic synthetic fibers and the acrylic composite fibers according to the present invention can be produced by using not only an organic solvent but also an inorganic solvent, such as aqueous solution of zinc chloride and the like.

The porous acrylic synthetic fibers obtained by the present invention have a high water absorption property and water absorbing rate and are excellent in strength and elongation under wet swelling when absorbing water, and have good luster and brightness when dyed. The acrylic composite fibers of the present invention have a high water absorption property, water absorbing rate, excellent strength and elongation when absorbing water, good dyeability and unique bulkiness and rich feeling of the inherent composite fibers.

In the natural fibers, the bulkiness and resilient feeling are lost upon wet swelling but in the acrylic synthetic fibers and acrylic composite fibers according to the present invention, the water absorption is a physical mechanism in which water is absorbed in voids in the fibers, so that these fibers are not deteriorated in the bulkiness and resilient feeling and the water absorption property, water- and moisture-permeability are excellent. In addition, acrylic synthetic fibers and composite fibers according to the present invention have a porosity of 0.05~0.75 $cm^3/g$ and are light in weight and very high in the heat retaining property.

The acrylic synthetic fibers and composite fibers of the present invention, which have such many excellent properties, are optimum for general clothings, sports wears, bedding, curtains, interior and the like. Furthermore, these fibers are satisfactorily used in the field where cotton has been used, as cotton substitutes.

The following examples are given for the purpose of illustration of this invention and are not intended as limitations thereof. In the examples, parts and % mean parts by weight and % by weight unless otherwise indicated. The water absorption of fibers was measured according to DIN-53814, and the crimp property thereof was measured according to JIS L-1074.

EXAMPLE 1

A dimethyl formamide (hereinafter abbreviated as DMF) solution containing 21% of a polymer mixture consisting of an acrylic polymer and cellulose acetate in a mixing ratio shown in the following Table 1 was extruded from a spinneret into a coagulation bath consisting of 65% of DMF and 35% of water and kept at 20° C. The acrylic polymer had a composition of acrylonitrile (hereinafter abbreviated as AN):methyl acrylate (hereinafter abbreviated as MA):sodium methallylsulfonate (hereinafter abbreviated as SMAS)=90.5:9.0:0.5(%). The extruded filaments were subjected to a primary drawing to draw the filaments to 5 times their original length, and then dried by means of a hot roller type drier kept at 120° C. until the water content of the filaments was decreased to 0.5%. The dried filaments were subjected to a secondary drawing at 100° C. under wet heat to draw the filaments to 1.1 times their original length. The drawn filaments were mechanically crimped and the crimps were set to obtain 3-denier fibers. Properties of the resulting fibers are shown in Table 1. It was found that the ratios of microvoids in the fibers of Experiment Nos. 4 and 5 were 11.3% and 14.6%, respectively.

TABLE 1

| | Polymer mixture | | Void | | | Fiber property | | | |
|---|---|---|---|---|---|---|---|---|---|
| Experiment number | Acrylic polymer (parts) | Cellulose acetate (parts) | Porosity, V ($cm^3/g$) | Surface area, A ($m^2/g$) | V/A | Water absorption (%) | Strength (g/d) | Dyeability | Remarks |
| 1 | 100 | 0 | 0.000 | 0.00 | — | 4 | 3.8 | good | Comparative sample |
| 2 | 99 | 1 | 0.021 | 0.57 | $\frac{1}{27.1}$ | 4 | 3.8 | good | Comparative sample |
| 3 | 98 | 2 | 0.116 | 1.62 | $\frac{1}{14.0}$ | 15 | 3.8 | good | Present invention |
| 4 | 95 | 5 | 0.221 | 1.70 | $\frac{1}{7.7}$ | 25 | 3.6 | good | Present invention |

TABLE 1-continued

| Experiment number | Polymer mixture: Acrylic polymer (parts) | Polymer mixture: Cellulose acetate (parts) | Void: Porosity, V ($cm^3/g$) | Void: Surface area, A ($m^2/g$) | Void: V/A | Fiber property: Water absorption (%) | Fiber property: Strength (g/d) | Fiber property: Dyeability | Remarks |
|---|---|---|---|---|---|---|---|---|---|
| 5 | 90 | 10 | 0.357 | 2.04 | $\frac{1}{5.7}$ | 38 | 3.2 | good | Present invention |
| 6 | 80 | 20 | 0.46 | 2.35 | $\frac{1}{5.7}$ | 48 | 2.6 | somewhat poor | Present invention |
| 7 | 70 | 30 | 0.588 | 2.76 | $\frac{1}{4.7}$ | 60 | 1.7 | somewhat poor | Present invention |
| 8 | 65 | 35 | 0.798 | 3.09 | $\frac{1}{3.7}$ | 80 | 1.1 | poor | Comparative sample |
| 9 | 60 | 40 | 1.08 | 3.09 | $\frac{1}{2.9}$ | 100 | 0.8 | poor | Comparative sample |

EXAMPLE 2

The same acrylic polymer as used in Example 1 was used, and 3-denier fibers shown in the following Table 2 were produced by changing the composition of the polymer mixture, the extruding condition, the drawing condition, the drying condition and other production conditions. Properties of the resulting fibers are shown in Table 2.

TABLE 2(a)

| Experiment number | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|
| 10 | 0.03 | 0.71 | $\frac{1}{23}$ | 5 | poor in heat resistance and in dyeability | Comparative sample |
| 11 | 0.05 | 1.82 | $\frac{1}{36}$ | 9 | poor in heat resistance and in dyeability | Comparative sample |
| 12 | 0.10 | 0.44 | $\frac{1}{4.4}$ | 14 | | Present invention |
| 13 | 0.35 | 2.11 | $\frac{1}{6.0}$ | 37 | | Present invention |
| 14 | 0.75 | 17.3 | $\frac{1}{23}$ | 70 | low strength and poor dyeability | Comparative sample |
| 15 | 0.90 | 25.1 | $\frac{1}{28}$ | 87 | low strength and poor dyeability | Comparative sample |
| 16 | 1.05 | 9.83 | $\frac{1}{9.4}$ | 104 | low strength and poor dyeability | Comparative sample |
| 17 | 0.43 | 0.94 | $\frac{1}{2.2}$ | 45 | | Present invention |

TABLE 2(b)

| Experiment number | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|
| 18 | 0.59 | 0.78 | $\frac{1}{1.3}$ | 60 | | Present invention |
| 19 | 0.30 | 13.8 | $\frac{1}{46}$ | 33 | poor in heat resistance and in dyeability | Comparative sample |
| 20 | 0.61 | 16.8 | $\frac{1}{27}$ | 63 | low strength and poor dyeability | Comparative sample |
| 21 | 0.51 | 19.1 | $\frac{1}{37}$ | 50 | low strength and poor dyeability | Comparative sample |
| 22 | 0.80 | 26.9 | $\frac{1}{33}$ | 76 | poor in heat resistance and in dyeability | Comparative sample |

TABLE 2(b)-continued

| Experiment number | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|
| 23 | 0.72 | 0.95 | $\frac{1}{1.3}$ | 73 | | Present invention |
| 24 | 0.63 | 3.21 | $\frac{1}{5.1}$ | 64 | | Present invention |

EXAMPLE 30

A polymer mixture consisting of 80 parts of an acrylic polymer, which had a composition of AN:MA:sodium allylsulfonate (hereinafter abbreviated as SAS)=90.2:9.0:0.8(%), and 20 parts of cellulose acetate was dissolved in a solvent shown in the following Table 3 to prepare spinning solutions having a property shown in Table 3. The extrusion of the spinning solution and the after-treatment of the extruded filaments were carried out under the same conditions as described in Example 1 to obtain 3-denier fibers. However, as the coagulation bath, an aqueous solution containing the same solvent as that used in the spinning solution was used.

Properties of the fibers are shown in Table 3. In Table 3, the viscosity of the spinning solution was measured at 50° C. by means of a Brookfield viscometer. The stability of the spinning solution was estimated by the stability against gellation at 50° C. and by the stability of dispersion of the acrylic polymer and cellulose acetate in the spinning solution.

TABLE 3(a)

| Experiment number | Spinning solution: Solvent | Spinning solution: Concentration of polymer mixture (%) | Spinning solution: Viscosity (poise) | Spinning solution: Stability | Void: Porosity, V ($cm^3/g$) | Void: Surface area, A ($m^2/g$) | Void: V/A | Fiber property: Water absorption (%) | Fiber property: Strength (g/d) | Fiber property: Operability | Remarks |
|---|---|---|---|---|---|---|---|---|---|---|---|
| 25 | Dimethyl acetamide | 10 | 8.5 | good | 0.57 | 17.9 | $\frac{1}{31.4}$ | 58 | 1.8 | somewhat poor | Comparative sample |
| 26 | Dimethyl acetamide | 15 | 15 | good | 0.51 | 3.14 | $\frac{1}{6.2}$ | 53 | 1.9 | good | Present invention |
| 27 | Dimethyl acetamide | 20 | 76 | good | 0.48 | 2.62 | $\frac{1}{5.4}$ | 50 | 2.5 | good | Present invention |
| 28 | Dimethyl acetamide | 25 | 210 | good | 0.46 | 2.48 | $\frac{1}{5.4}$ | 48 | 2.7 | good | Present invention |
| 29 | Dimethyl acetamide | 30 | 640 | good | 0.47 | 2.24 | $\frac{1}{4.8}$ | 49 | 2.6 | good | Present invention |
| 30 | Dimethyl acetamide | 35 | >1,000 | somewhat poor | 0.43 | 1.96 | $\frac{1}{4.6}$ | 45 | 2.4 | somewhat poor | Present invention |
| 31 | Dimethyl acetamide | 40 | gelled | poor | 0.42 | 1.86 | $\frac{1}{4.4}$ | 44 | 2.1 | poor | Comparative sample |

TABLE 3(b)

| Experiment number | Spinning solution: Solvent | Spinning solution: Concentration of polymer mixture (%) | Spinning solution: Viscosity (poise) | Spinning solution: Stability | Void: Porosity, V ($cm^3/g$) | Void: Surface area, A ($m^2/g$) | Void: V/A | Fiber property: Water absorption (%) | Fiber property: Strength (g/d) | Fiber property: Operability | Remarks |
|---|---|---|---|---|---|---|---|---|---|---|---|
| 32 | Dimethyl formamide | 10 | 5.6 | good | 0.56 | 18.4 | $\frac{1}{32.8}$ | 56 | 2.1 | somewhat poor | Comparative sample |
| 33 | Dimethyl formamide | 15 | 15 | good | 0.49 | 2.70 | $\frac{1}{5.5}$ | 52 | 2.6 | good | Present invention |
| 34 | Dimethyl formamide | 20 | 50 | good | 0.46 | 2.35 | $\frac{1}{5.1}$ | 48 | 2.6 | good | Present invention |
| 35 | Dimethyl formamide | 25 | 140 | good | 0.47 | 2.31 | $\frac{1}{4.9}$ | 49 | 2.7 | good | Present invention |
| 36 | Dimethyl formamide | 30 | 420 | good | 0.46 | 2.26 | $\frac{1}{4.9}$ | 48 | 2.9 | good | Present invention |
| 37 | Dimethyl formamide | 35 | 1,200 | somewhat poor | 0.41 | 2.95 | $\frac{1}{7.2}$ | 43 | 2.7 | somewhat poor | Present invention |

TABLE 3(b)-continued

| Experiment number | Spinning solution: Solvent | Concentration of polymer mixture (%) | Viscosity (poise) | Stability | Void: Porosity, V ($cm^3/g$) | Void: Surface area, A ($m^2/g$) | Void: V/A | Fiber property: Water absorption (%) | Fiber property: Strength (g/d) | Operability | Remarks |
|---|---|---|---|---|---|---|---|---|---|---|---|
| 38 | Dimethyl formamide | 40 | gelled | poor | 0.43 | 2.75 | $\frac{1}{6.4}$ | 45 | 2.6 | poor | Comparative sample |

TABLE 3(c)

| Experiment number | Spinning solution: Solvent | Concentration of polymer mixture (%) | Viscosity (poise) | Stability | Void: Porosity, V ($cm^3/g$) | Void: Surface area, A ($m^2/g$) | Void: V/A | Fiber property: Water absorption (%) | Fiber property: Strength (g/d) | Operability | Remarks |
|---|---|---|---|---|---|---|---|---|---|---|---|
| 39 | Dimethyl sulfoxide | 10 | 15 | good | 0.50 | 16.1 | $\frac{1}{32.2}$ | 49 | 2.3 | somewhat poor | Comparative sample |
| 40 | Dimethyl sulfoxide | 15 | 44 | good | 0.46 | 3.15 | $\frac{1}{6.8}$ | 47 | 2.4 | good | Present invention |
| 41 | Dimethyl sulfoxide | 20 | 130 | good | 0.44 | 2.15 | $\frac{1}{4.9}$ | 46 | 2.7 | good | Present invention |
| 42 | Dimethyl sulfoxide | 25 | 390 | good | 0.45 | 2.35 | $\frac{1}{5.2}$ | 48 | 2.6 | good | Present invention |
| 43 | Dimethyl sulfoxide | 30 | 1,100 | good | 0.43 | 2.21 | $\frac{1}{5.1}$ | 45 | 2.4 | good | Present invention |
| 44 | Dimethyl sulfoxide | 35 | gelled | somewhat poor | 0.39 | 2.16 | $\frac{1}{5.5}$ | 41 | 2.3 | somewhat poor | Present invention |
| 45 | Dimethyl sulfoxide | 40 | gelled | poor | 0.36 | 2.03 | $\frac{1}{5.6}$ | 38 | 2.0 | poor | Comparative sample |

EXAMPLE 4

A polymer mixture consisting of 90 parts of an acrylic polymer, which had a composition of AN:MA:SMAS=90.5:9.0:0.5(%), and 10 parts of cellulose acetate was dissolved in DMF to prepare a spinning solution containing 25% of the polymer mixture. The spinning solution was extruded from a spinneret into a coagulation bath consisting of 65% of DMF and 35% of water and kept at 25° C., and the extruded filaments were subjected to a primary drawing in various draw ratios shown in the following Table 4. The primarily drawn filaments were dried and after-treated under the same conditions as described in Example 1 to obtain 3-denier fibers. Properties of the resulting fibers are shown in Table 4.

TABLE 4

| Experiment number | Draw ratio in primary drawing | Void: Porosity V ($cm^3/g$) | Void: Surface area, A ($m^2/g$) | Void: V/A | Fiber property: Water absorption (%) | Fiber property: Others | Remarks |
|---|---|---|---|---|---|---|---|
| 46 | 1.5 | 0.381 | 3.05 | $\frac{1}{8.0}$ | 40.3 | dried filaments are brittle, and operability thereof is poor | Comparative sample |
| 47 | 2 | 0.362 | 2.01 | $\frac{1}{5.6}$ | 38.5 | dried filaments are brittle, and operability thereof is poor | Comparative sample |
| 48 | 3 | 0.368 | 1.99 | $\frac{1}{5.4}$ | 39.0 | | Present invention |
| 49 | 4 | 0.352 | 2.01 | $\frac{1}{5.7}$ | 37.5 | | Present invention |
| 50 | 5 | 0.337 | 1.71 | $\frac{1}{5.1}$ | 36.1 | | Present invention |
| 51 | 6 | 0.326 | 1.58 | $\frac{1}{4.8}$ | 35.0 | | Present invention |
| 52 | 7 | 0.294 | 1.75 | $\frac{1}{6.0}$ | 32.0 | | Present invention |

TABLE 4-continued

| Experiment number | Draw ratio in primary drawing | Void: Porosity V ($cm^3/g$) | Void: Surface area, A ($m^2/g$) | Void: V/A | Fiber property: Water absorption (%) | Fiber property: Others | Remarks |
|---|---|---|---|---|---|---|---|
| 53 | 8 | 0.126 | 0.84 | $\frac{1}{6.7}$ | 16.0 | | Present invention |
| 54 | 9 | 0.04 | 0.28 | $\frac{1}{7.0}$ | 8.0 | yarn breakage occurs often | Comparative sample |

EXAMPLE 5

A polymer mixture consisting of 90 parts of an acrylic polymer, which had a composition of AN:MA:SMAS=92.5:7.0:0.5(%), and 10 parts of cellulose acetate was dissolved in DMF to prepare a spinning solution containing 25% of the polymer mixture, and the spinning solution was extruded from a spinneret into a coagulation bath consisting of 60% of DMF and 40% of water and kept at 30° C. The extruded filaments were subjected to a primary drawing to draw the filaments to 4.0 times their original length, and then dried until the water content of the filaments was decreased to not more than 0.5% by means of a hot roller type drier kept at a drying temperature shown in the following Table 5. The dried filaments were then subjected to a secondary drawing at 110° C. under wet heat to draw the filaments to 2 times their original length, and then mechanically crimped, and the crimps were set to obtain 3-denier fibers. Properties of the fibers are shown in Table 5.

EXAMPLE 6

A polymer mixture consisting of 85 parts of an acrylic polymer, which had a composition of AN:MA:SAS=89:10.4:0.6(%), and 15 parts of cellulose acetate was dissolved in DMF to prepare a spinning solution containing 27% of the polymer mixture, and the spinning solution was extruded from a spinneret into a coagulation bath consisting of 70% of DMF and 30% of water and kept at 30° C. The extruded filaments were subjected to a primary drawing to draw the filaments to 5 times their original length, and the primarily drawn filaments were dried by means of a hot roller type drier kept at 125° C. to decrease the water content of the filaments to the water content shown in the following Table 6, and the dried filaments were subjected to the same aftertreatments as those described in Example 1 to obtain 2-denier fibers.

Properties of the fibers are shown in Table 6. Further, the fibers of Experiment Nos. 67 and 69 had ratios of microvoids of 15.3% and 14.2%, respectively.

TABLE 5

| Experiment number | Drying temperature (°C.) | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|
| 55 | 60 | 0.60 | 26.4 | $\frac{1}{44.0}$ | 56.1 | poor in yarn property and in dyeability | Comparative sample |
| 56 | 80 | 0.57 | 19.6 | $\frac{1}{34.1}$ | 50.3 | poor in yarn property and in dyeability | Comparative sample |
| 57 | 100 | 0.50 | 7.5 | $\frac{1}{15.0}$ | 51.6 | | Present invention |
| 58 | 120 | 0.41 | 2.34 | $\frac{1}{5.7}$ | 43.0 | | Present invention |
| 59 | 140 | 0.35 | 1.89 | $\frac{1}{5.4}$ | 37.3 | | Present invention |
| 60 | 150 | 0.30 | 1.61 | $\frac{1}{5.4}$ | 32.6 | | Present invention |
| 61 | 160 | 0.25 | 1.30 | $\frac{1}{5.2}$ | 27.8 | | Present invention |
| 62 | 180 | 0.23 | 1.18 | $\frac{1}{5.1}$ | 25.9 | | Present invention |
| 63 | 190 | 0.21 | 1.05 | $\frac{1}{5.0}$ | 24.0 | fiber colors, and becomes rigid | Comparative sample |
| 64 | 200 | 0.21 | 0.97 | $\frac{1}{4.6}$ | 24.0 | fiber colors, and becomes rigid | Comparative sample |

TABLE 6

| Experiment number | Water content (%) | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|
| 65 | 0 | 0.433 | 2.68 | $\frac{1}{6.2}$ | 45.2 | | Present invention |
| 66 | 0.1 | 0.457 | 3.23 | $\frac{1}{7.1}$ | 47.5 | | Present invention |
| 67 | 0.2 | 0.505 | 3.65 | $\frac{1}{8.0}$ | 52.1 | | Present invention |
| 68 | 0.3 | 0.546 | 4.10 | $\frac{1}{7.5}$ | 56.0 | | Present invention |
| 69 | 0.5 | 0.582 | 4.42 | $\frac{1}{7.6}$ | 59.4 | | Present invention |
| 70 | 1.0 | 0.648 | 5.18 | $\frac{1}{8.0}$ | 65.7 | | Present invention |
| 71 | 2.0 | 0.694 | 27.76 | $\frac{1}{40.0}$ | 70.1 | low strength and poor dyeability, and uneven property | Comparative sample |
| 72 | 5.0 | 0.717 | 29.5 | $\frac{1}{41.1}$ | 72.3 | low strength and poor dyeability, and uneven property | Comparative sample |

EXAMPLE 7

The same spinning solution as that used in Example 6 was extruded from a spinneret into a coagulation bath consisting of 65% of DMF and 35% of water and kept at 25° C., and the extruded filaments were subjected to a primary drawing to draw the filaments to 4 times their original length. Then, the primarily drawn filaments were dried by means of a hot roller type drier kept at 125° C. until the water content of the filaments was decreased to not more than 0.7%. The dried filaments were subjected to a secondary drawing under the same secondary drawing condition as described in Example 5 and then mechanically crimped, and the crimps were set to obtain 3-denier fibers. Properties of the fibers are shown in the following Table 7.

TABLE 7(a)

| Experiment number | Secondary drawing condition: Temperature (°C.) | Secondary drawing condition: Draw ratio | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|---|
| 73 | 100 | 0.9 | 0.333 | 2.18 | $\frac{1}{6.6}$ | 35.7 | | Present invention |
| 74 | " | 1.0 | 0.334 | 2.20 | $\frac{1}{6.6}$ | 36.8 | | Present invention |
| 75 | " | 1.5 | 0.338 | 2.24 | $\frac{1}{6.6}$ | 36.2 | | Present invention |
| 76 | " | 2 | 0.297 | 2.32 | $\frac{1}{7.8}$ | 32.3 | | Present invention |
| 77 | " | 3 | 0.222 | 2.50 | $\frac{1}{11.2}$ | 25.1 | yarn breakage occurs | Present invention |
| 78 | 110 | 0.9 | 0.326 | 2.08 | $\frac{1}{6.4}$ | 35.0 | | Present invention |
| 79 | " | 1.0 | 0.359 | 2.12 | $\frac{1}{6.0}$ | 37.0 | | Present invention |
| 80 | " | 2 | 0.332 | 2.16 | $\frac{1}{6.6}$ | 35.6 | | Present invention |

TABLE 7(b)

| Experiment number | Secondary drawing condition: Temperature (°C.) | Secondary drawing condition: Draw ratio | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|---|
| 81 | 110 | 3 | 0.294 | 2.24 | $\frac{1}{7.6}$ | 32.0 | yarn breakage occurs | Present invention |

TABLE 7(b)-continued

| Experiment number | Secondary drawing condition Temperature (°C.) | Draw ratio | Void Porosity, V ($cm^3/g$) | Surface area, A ($m^2/g$) | V/A | Fiber property Water absorption (%) | Others | Remarks |
|---|---|---|---|---|---|---|---|---|
| 82 | " | 4 | 0.158 | 2.44 | 1/15.4 | 19.0 | frequent yarn breakage | Comparative sample |
| 83 | 120 | 0.8 | 0.286 | 1.80 | 1/6.2 | 31.2 | | Present invention |
| 84 | " | 1 | 0.323 | 1.82 | 1/5.6 | 34.8 | | Present invention |
| 85 | " | 2 | 0.329 | 1.84 | 1/5.6 | 35.1 | | Present invention |
| 86 | " | 3 | 0.297 | 2.02 | 1/6.8 | 32.3 | | Present invention |
| 87 | " | 4 | 0.169 | 2.46 | 1/14.6 | 20.1 | yarn breakage occurs | Comparative sample |
| 88 | " | 5 | — | — | — | — | spinning is impossible | Comparative sample |

TABLE 7(c)

| Experiment number | Secondary drawing condition Temperature (°C.) | Draw ratio | Void Porosity, V ($cm^3/g$) | Surface area, A ($m^2/g$) | V/A | Fiber property Water absorption (%) | Others | Remarks |
|---|---|---|---|---|---|---|---|---|
| 89 | 130 | 0.8 | 0.295 | 1.52 | 1/5.2 | 32.0 | | Present invention |
| 90 | " | 1 | 0.339 | 1.50 | 1/4.4 | 36.0 | | Present invention |
| 91 | " | 2 | 0.327 | 1.60 | 1/4.8 | 35.1 | | Present invention |
| 92 | " | 3 | 0.280 | 1.80 | 1/6.4 | 30.7 | | Present invention |
| 93 | " | 4 | 0.173 | 2.04 | 1/12.8 | 20.4 | yarn breakage occurs | Comparative sample |
| 94 | " | 5 | — | — | — | — | spinning is impossible | Comparative sample |

EXAMPLE 8

A polymer mixture consisting of 80 parts of an acrylic polymer, which had a composition of AN:MA:SMAS=90.5:9.0:0.5(%), and 20 parts of cellulose acetate was dissolved in DMF to prepare a DMF solution containing 20% of the polymer mixture. Then, 100 parts of the DMF solution was mixed with 2 parts of water to prepare a spinning solution, and the spinning solution was extruded from a spinneret into a coagulation bath consisting of 50% of DMF and 50% of water and kept at 25° C. The extruded filaments were washed with water and then subjected to a primary drawing in hot water to draw the filaments to 4 times their original length. The primarily drawn filaments was dried until the water content of the filaments was decreased to not more than 1.0% by means of a hot roller type dried kept at 135° C. The dried filaments were subjected to a secondary drawing at 115° C. under wet heat to draw the filaments to 2 times their original length and then mechanically crimped, and the crimps were set to obtain 3-denier fibers.

The resulting fiber was a somewhat dull porous acrylic fiber having voids and having a porosity V of 0.3 $cm^3/g$ and a surface area A of voids of 1.03 $m^2/g$, the ratio V/A being 1/3.43. The porous acrylic fiber had the following yarn properties; that is, a fineness of 2 deniers, a strength in dried state of 2.9 g/d and an elongation in dried state of 30.5%. Further, the fiber had a strength in wet state of 2.87 g/d and an elongation in wet state of 31.3%. Therefore, the yarn property of the fiber in the dried state was maintained in the wet state.

EXAMPLE 9

A polymer mixture consisting of (100-X) parts of an acrylic polymer, which had a composition of AN:MA:SMAS=90.5:9.0:0.5(%), and X parts of cellulose acetate was dissolved in DMF to prepare a spinning solution containing 23% of the polymer mixture. The spinning solution was extruded from a spinneret into a coagulation bath consisting of 65% of DMF and 35% of water and kept at 20° C. The extruded filaments were subjected to a primary drawing to draw the filaments to 5 times their original length, and the primarily drawn filaments were washed with water and dried until the water content of the filaments was decreased to 0.5% by means of a hot roller type drier kept at 120° C. The dried filaments were then subjected to a secondary drawing at 110° C. under wet heat to draw the filaments to 1.2 times their original length and then mechanically crimped, and the crimps were set to obtain 2-denier fibers.

For comparison, in Experiment No. 98, the above described polymer mixture was dissolved in DMF to prepare a spinning solution containing 23% of the polymer mixture, and the spinning solution was extruded from a spinneret into a coagulation bath consisting of 65% of DMF and 35% of water and kept at 40° C. The extruded filaments were subjected to a primary drawing to draw the filaments to 6 times their original length, and the primarily drawn filaments were washed with water, subjected to a heat treatment at 125° C. under wet heat without drawing and shrinking, and then dried. The dried filaments were mechanically crimped, and the crimps were set to obtain 2-denier fibers. In experiment No. 99, the above described acrylic polymer alone was dissolved in DMF to prepare a spinning solution containing 23% of the acrylic polymer alone, and the spinning solution was extruded from a spinneret into a coagulation bath consisting of 65% of DMF and 35% of water and kept at 40° C. The extruded filaments were subjected to a primary drawing to draw the filaments to 5 times their original length, and the primarily drawn filaments were washed with water, subjected to a secondary drawing at 110° C. under wet heat to draw the filaments to 1.2 times their original length, and then dried in the same manner as described above. The dried filaments were mechanically crimped and the crimps were set to obtain 2-denier fibers.

Properties of the fibers are shown in the following Table 8. The dyeability (depth and brilliancy) was evaluated by the depth of color when a black dye was deposited on the fiber in an amount of 4.5% based on the amount of the fiber. In the evaluation of the dyeability, the depth of color of commercially available acrylic fiber (Kanebo Acryl Regular type) is graded as 5th grade. The larger the value, the more the sample fiber has a deeper and more brilliant color.

TABLE 8

| Experiment number | Polymer mixture X (parts) | Ratio of microvoid (%) | Water absorption (%) | Yarn property Strength (g/d) | Yarn property Elongation (%) | Dyeability (depth and brilliancy) (grade) | Remarks |
|---|---|---|---|---|---|---|---|
| 95 | 4 | 10.2 | 21 | 3.6 | 39 | 4 | Present invention |
| 96 | 10 | 12.4 | 38 | 3.2 | 36 | 4 | Present invention |
| 97 | 15 | 16.0 | 43 | 3.0 | 33 | 3 ~ 4 | Present invention |
| 98 | 4 | 78.6 | 24 | 2.2 | 26 | 1 ~ 2 | Comparative sample |
| 99 | 0 | 44.9 | 9 | 2.5 | 32 | 2 | Comparative sample |

EXAMPLE 10

A polymer mixture consisting of 85 parts of an acrylic polymer (I), which had a composition of AN:MA:SMAS=90.5:9.0:0.5(%), 15 parts of cellulose acetate (II), and a variable amount of an acrylic copolymer (III), which had a composition of AN:$CH_2$=-CH—COO—$(CH_2CH_2O)_9CH_3$=85:15(%), was dissolved in DMF to prepare a spinning solution containing 23% of the polymer mixture. The spinning solution was extruded from a spinneret into a coagulation bath consisting of 56% of DMF and 44% of water and kept at 20° C., and the extruded filaments were subjected to a primary drawing to draw the filaments to 5 times their original length. The primarily drawn filaments were dried until the water content in the filaments was decreased to 0.7% by means of a hot roller type drier kept at 120° C., and then subjected to a secondary drawing at 100° C. under wet heat to draw the filaments to 1.1 times their original length. The filaments were mechanically crimped, and the crimps were set to obtain 3-denier fibers. Properties of the fibers are shown in the following Table 9.

TABLE 9

| Experiment number | Polymer mixture parts [I] | [II] | [III] | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|---|---|
| 100 | 85 | 15 | 0.5 | 0.41 | 2.01 | $\frac{1}{4.9}$ | 43 | good in luster and in dyeability | Present invention |
| 101 | " | " | 2 | 0.40 | 1.97 | $\frac{1}{4.9}$ | 43 | good in luster and in dyeability | Present invention |
| 102 | " | " | 5 | 0.39 | 1.95 | $\frac{1}{5.0}$ | 40 | good in luster and in dyeability | Present invention |
| 103 | " | " | 10 | 0.34 | 1.96 | $\frac{1}{5.8}$ | 36 | good in luster and in dyeability | Present invention |
| 104 | " | " | 30 | 0.26 | 1.74 | $\frac{1}{6.7}$ | 29 | good in luster and in dyeability | Present invention |

TABLE 9-continued

| Experiment number | Polymer mixture parts [I] | [II] | [III] | Void: Porosity, V ($cm^3/g$) | Surface area, A ($m^2/g$) | V/A | Fiber property: Water absorption (%) | Others | Remarks |
|---|---|---|---|---|---|---|---|---|---|
| 105 | " | " | 50 | 0.16 | 1.03 | $\frac{1}{6.4}$ | 17 | good in luster and in dyeability | Present invention |
| 106 | " | " | 60 | 0.03 | 0.36 | $\frac{1}{12.0}$ | 5 | poor heat resistance | Comparative sample |

EXAMPLE 11

A polymer mixture consisting of 85 parts of an acrylic polymer (I), which had a composition of AN:MA:SAS=90.3:9.0:0.7(%), 15 parts of cellulose acetate (II) and 2 parts of an acrylic copolymer (III), which was a copolymer of 90% of AN and 10% of a monomer shown by the following general formula, was dissolved in DMF to prepare a spinning solution containing 27% of the polymer mixture. The extrusion of the spinning solution, and the after-treatment of the extruded filaments were carried out under the same condition as described in Example 10 to obtain 3-denier fibers.

The general formula of the above described monomer is as follows:

$$CH_2{=}CH{-}COOX$$

wheren X represents $R_2$ or $$\text{-}(CH_2CH_2O)_l\text{-}(CH_2\overset{\overset{CH_3}{|}}{C}HO)_m\text{-}R_3$$

($R_2$, $R_3$, l and m are shown in the following Table 10).

Properties of the resulting fibers are shown in Table 10.

TABLE 10

| Experiment number | Monomer $R_2$ | $R_3$ | l | m | Void: Porosity, V ($cm^3/g$) | Surface area, A ($m^2/g$) | V/A | Fiber property: Water absorption (%) | Others | Remarks |
|---|---|---|---|---|---|---|---|---|---|---|
| 107 | H | — | — | — | 0.34 | 1.51 | $\frac{1}{4.4}$ | 35 | good in luster and dyeability | Present invention |
| 108 | — | H | 8 | 0 | 0.40 | 1.99 | $\frac{1}{5.0}$ | 43 | good in luster and dyeability | Present invention |
| 109 | — | H | 0 | 15 | 0.42 | 2.10 | $\frac{1}{5.0}$ | 44 | good in luster and dyeability | Present invention |
| 110 | — | $CH_3$ | 10 | 15 | 0.43 | 2.15 | $\frac{1}{5.0}$ | 46 | good in luster and dyeability | Present invention |
| 111 | — | H | 20 | 20 | 0.45 | 2.17 | $\frac{1}{4.8}$ | 48 | good in luster and dyeability | Present invention |

EXAMPLE 12

A polymer mixture consisting of 90 parts of an acrylic polymer, which had a composition of AN:MA:SMAS=90.5:9.0:0.5(%), and 10 parts of cellulose acetate was dissolved in DMF to prepare a spinning solution containing 23% of the polymer mixture. The spinning solution was extruded for a spinneret into a coagulation bath consisting of 60% of DMF and 40% of water and kept at a temperature shown in the following Table 11, and then the extruded filaments were subjected to a primary drawing to draw the filaments to 5 times their original length. The primarily drawn filaments were washed with water, dried so that the water content of the filaments would be decreased to not more than 1%, and then subjected to a secondary drawing at 110° C. under wet heat to draw the filaments to 1.4 times their original length. The secondarily drawn filaments were mechanically crimped, and the crimps were set to obtain 2-denier fibers. Properties of the fibers are shown in the following Table 11.

The fiber of Experiment No. 114 had a porosity of 1.10 $cm^3/g$ before drying, a porosity of 0.213 $cm^3/g$ after drying (before secondary drawing), and a porosity of 0.336 $cm^3/g$ after secondary drawing.

TABLE 11

| Experiment number | Coagulation bath temperature (°C.) | Ratio of microvoid (%) | Fiber property: Water absorption (%) | Yarn property: Strength (g/d) | Elongation (%) | Dyeability (depth and brilliancy) (grade) | Heat resistance | Remarks |
|---|---|---|---|---|---|---|---|---|
| 112 | 10 | 7.8 | 38 | 3.4 | 37 | 4 | good | Present invention |

TABLE 11-continued

| Experiment number | Coagulation bath temperature (°C.) | Ratio of microvoid (%) | Fiber property: Water absorption (%) | Yarn property: Strength (g/d) | Yarn property: Elongation (%) | Dyeability (depth and brilliancy) (grade) | Heat resistance | Remarks |
|---|---|---|---|---|---|---|---|---|
| 113 | 15 | 7.7 | 35 | 3.3 | 39 | 4 | good | Present invention |
| 114 | 20 | 11.8 | 37 | 3.2 | 38 | 4 | good | Present invention |
| 115 | 25 | 15.7 | 39 | 3.2 | 37 | 3 ~ 4 | good | Present invention |
| 116 | 30 | 19.3 | 41 | 3.1 | 34 | 3 | good | Present invention |
| 117 | 35 | 34.0 | 43 | 2.7 | 29 | 2 | somewhat poor | Comparative sample |
| 118 | 40 | 49.0 | 45 | 2.4 | 25 | 1 ~ 2 | poor | Comparative sample |

EXAMPLE 13

A polymer component A consisting of (100-C) parts of an acrylic polymer, which had a composition of AN:MA:SMAS=90.6:9.0:0.4(%), and C parts of cellulose acetate was dissolved in DMF to prepare a spinning solution A containing 22% of the polymer component A. A polymer component B consisting of the same acrylic polymer as used in the polymer component A was dissolved in DMF to prepare a spinning solution B containing 22% of the polymer component B. The spinning solutions A and B were extruded in a conjugate ratio of 5/5 (weight ratio) from a spinneret designed for side-by-side conjugate spinning into a coagulation bath consisting of a 65% DMF aqueous solution kept at 20° C.

The extruded filaments were subjected to a primary drawing to draw the filaments to 6 times their original length. The primarily drawn filaments were dried by means of a hot roller type drier kept at 120° C. until the water content of the filaments was decreased to 0.7%, and then subjected to a secondary drawing at 100° C. under wet heat to draw the filaments to 1.1 times their original length. The secondarily drawn filaments were mechanically crimped, and the crimps were set to obtain 3-denier fibers. The resulting acrylic composite fibers had substantially no latent crimpability. Properties of the fibers are shown in the following Table 12.

TABLE 12

| Experiment number | Polymer component A C (parts) | Void: Porosity ($cm^3/g$) | Void: Surface area ($m^2/g$) | Fiber property: Water absorption (%) | Dyeability | Others | Remarks |
|---|---|---|---|---|---|---|---|
| 119 | 0 | 0.00 | 0.00 | 4 | good | good luster | Comparative sample |
| 120 | 1 | 0.021 | 0.28 | 6 | good | good luster | Comparative sample |
| 121 | 2 | 0.074 | 0.72 | 11 | good | good luster | Present invention |
| 122 | 5 | 0.137 | 0.88 | 17 | good | good luster | Present invention |
| 123 | 10 | 0.221 | 1.02 | 25 | good | good luster | Present invention |
| 124 | 20 | 0.305 | 1.22 | 33 | good | good luster | Present invention |
| 125 | 40 | 0.609 | 1.58 | 62 | good | good luster | Present invention |
| 126 | 50 | 0.714 | 1.83 | 72 | somewhat poor | good luster | Present invention |
| 127 | 60 | 0.924 | 2.16 | 92 | poor | poor yarn property and somewhat poor luster | Comparative sample |

EXAMPLE 14

A polymer component A consisting of (100-C) parts of an acrylic polymer, which had a composition of AN:AM:SMAS=90.6:9.0:0.4(%), and C parts of cellulose acetate was dissolved in DMF to prepare a spinning solution A containing 22% of the polymer component A. A polymer component B consisting of an acrylic polymer having a composition of AN:MA:SMAS=90.4:9.0:0.6(%) was dissolved in DMF to prepare a spinning solution B containing 22% of the polymer component B. The spinning solutions A and B were extruded in various conjugate ratios from a spinneret, which was designed for bonding the spinning solutions A and B in a side-by-side relation, into a coagulation bath consisting of a 65% DMF aqueous solution kept at 20° C. Then, the extruded filaments were subjected to after-treatments in the same manner as described in Example 13 to obtain 3-denier acrylic composite fibers. Properties of the composite fibers are shown in the following Table 13. The resulting composite fibers had substantially no latent crimpability.

TABLE 13(a)

| Experiment number | Polymer component A C (parts) | Conjugate ratio of A/B (weight ratio) | Void | | Fiber property | | | Remarks |
|---|---|---|---|---|---|---|---|---|
| | | | Porosity ($cm^3/g$) | Surface area ($m^2/g$) | Water Absorption (%) | Dyeability | Others | |
| 128 | 2 | 1/9 | 0.01 | 0.17 | 4 | good | poor water absorption | Comparative sample |
| 129 | 2 | 2/8 | 0.03 | 0.33 | 6 | good | somewhat poor water absorption | Present invention |
| 130 | 2 | 3/7 | 0.04 | 0.49 | 7 | good | somewhat poor water absorption | Present invention |
| 131 | 2 | 5/5 | 0.06 | 0.81 | 12 | good | | Present invention |
| 132 | 2 | 7/3 | 0.09 | 0.93 | 12 | good | | Present invention |
| 133 | 2 | 8/2 | 0.10 | 1.07 | 13 | good | | Present invention |
| 134 | 2 | 9/1 | 0.12 | 1.46 | 14 | somewhat poor | | Comparative sample |
| 135 | 10 | 1/9 | 0.03 | 0.21 | 4 | good | poor water absorption | Comparative sample |
| 136 | 10 | 2/8 | 0.07 | 0.41 | 13 | good | | Present invention |
| 137 | 10 | 3/7 | 0.13 | 0.63 | 17 | good | | Present invention |
| 138 | 10 | 5/5 | 0.24 | 1.02 | 27 | good | | Present invention |

TABLE 13(b)

| Experiment number | Polymer component A C (parts) | Conjugate ratio of A/B (weight ratio) | Void | | Fiber property | | | Remarks |
|---|---|---|---|---|---|---|---|---|
| | | | Porosity ($cm^3/g$) | Surface area ($m^2/g$) | Water Absorption (%) | Dyeability | Others | |
| 139 | 10 | 6/4 | 0.25 | 1.22 | 28 | good | | Present invention |
| 140 | 10 | 7/3 | 0.29 | 1.44 | 32 | good | | Present invention |
| 141 | 10 | 8/2 | 0.32 | 1.63 | 35 | somewhat poor | somewhat poor luster | Present invention |
| 142 | 10 | 9/1 | 0.38 | 1.84 | 41 | poor | poor luster | Comparative sample |
| 143 | 30 | 1/9 | 0.06 | 0.28 | 7 | good | poor water absorption | Comparative sample |
| 144 | 30 | 2/8 | 0.12 | 0.54 | 14 | good | | Present invention |
| 145 | 30 | 3/7 | 0.18 | 0.83 | 21 | good | | Present invention |
| 146 | 30 | 5/5 | 0.24 | 1.39 | 33 | good | | Present invention |
| 147 | 30 | 6/4 | 0.35 | 1.68 | 39 | good | | Present invention |
| 148 | 30 | 7/3 | 0.41 | 1.91 | 42 | somewhat poor | somewhat poor luster | Present invention |
| 149 | 30 | 8/2 | 0.47 | 2.20 | 49 | somewhat poor | somewhat poor luster | Present invention |

TABLE 13(c)

| Experiment number | Polymer component A C (parts) | Conjugate ratio of A/B (weight ratio) | Void | | Fiber property | | | Remarks |
|---|---|---|---|---|---|---|---|---|
| | | | Porosity ($cm^3/g$) | Surface area ($m^2/g$) | Water Absorp- (%) | Dyeability | Others | |
| 150 | 30 | 9/1 | 0.53 | 2.48 | 54 | poor | poor luster | Comparative sample |
| 151 | 50 | 1/9 | 0.04 | 0.31 | 10 | good | poor water absorption | Comparative sample |
| 152 | 50 | 2/8 | 0.24 | 0.74 | 27 | good | | Present invention |
| 153 | 50 | 3/7 | 0.39 | 1.12 | 43 | good | | Present invention |
| 154 | 50 | 5/5 | 0.68 | 1.86 | 71 | good | | Present invention |
| 155 | 50 | 6/4 | 0.79 | 2.23 | 85 | somewhat poor | somewhat poor luster | Comparative sample |
| 156 | 50 | 7/3 | 0.97 | 2.61 | 97 | somewhat | poor in luster and | Comparative |

TABLE 13(c)-continued

| Experiment number | Polymer component A C (parts) | Conjugate ratio of A/B (weight ratio) | Void: Porosity ($cm^3/g$) | Void: Surface area ($m^2/g$) | Fiber property: Water Absorp- (%) | Fiber property: Dyeability | Fiber property: Others | Remarks |
|---|---|---|---|---|---|---|---|---|
| | | | | | | poor | in yarn property | sample |
| 157 | 50 | 8/2 | 1.07 | 2.98 | 110 | poor | poor in luster and in yarn property | Comparative sample |
| 158 | 50 | 9/1 | 1.21 | 3.38 | 126 | poor | poor in luster and in yarn property | Comparative sample |

EXAMPLE 15

A polymer component A consisting of 85 parts of an acrylic polymer, which had a composition of AN:-MA:SMAS=90.4:9.0:0.6(%), and 15 parts of cellulose acetate was dissolved in DMF to prepare a spinning solution A containing 22% of the polymer component A. A polymer component B consisting of the same acrylic polymer as used in the polymer component A was dissolved in DMF to prepare a spinning solution B containing 22% of the polymer component B. The spinning solutions A and B were extruded from a spinneret in a side-by-side relation and in a conjugate ratio (weight ratio) of component A/component B of 5/5 into a coagulation bath consisting of 60% of DMF and 40% of water and kept at a temperature shown in the following Table 14. The extruded filaments were subjected to a primary drawing to draw the filaments to 5 times their original length. Then, the primarily drawn filaments were washed with water, dried by means of a hot roller type drier kept at 120° C. until the water content of the filaments was decreased to not more than 1%, and then subjected to a secondary drawing at 110° C. under wet heat to draw the filaments to 1.2 times their original length. The secondarily drawn filaments were mechanically crimped and the crimps were set to obtain 2-denier composite fibers. Properties of the fibers are shown in Table 14. The evaluation of the dyeability was carried out in the same manner as described in Example 9.

TABLE 14

| Experiment number | Coagulation bath temperature (°C.) | Ratio of microvoid (%) | Fiber property: Water absorption (%) | Fiber property: Yarn property: Strength (g/d) | Fiber property: Yarn property: Elongation (%) | Fiber property: Dyeability (depth and brilliancy) (grade) | Remarks |
|---|---|---|---|---|---|---|---|
| 159 | 10 | 7.4 | 27 | 3.5 | 41 | 4 ~ 5 | Present invention |
| 160 | 15 | 7.2 | 27 | 3.3 | 39 | 4 | Present invention |
| 161 | 20 | 11.3 | 29 | 3.4 | 38 | 4 | Present invention |
| 162 | 25 | 15.1 | 30 | 3.2 | 34 | 4 | Present invention |
| 163 | 30 | 19.7 | 31 | 3.0 | 33 | 3 ~ 4 | Present invention |
| 164 | 35 | 35.6 | 33 | 2.6 | 28 | 2 | Comparative sample |
| 165 | 40 | 51.2 | 32 | 2.4 | 28 | 2 | Comparative sample |

EXAMPLE 16

A polymer component A consisting of 80 parts of an acrylic polymer, which had a composition of AN:-MA:SMAS=91.5:8.0:0.5(%), and 20 parts of cellulose acetate and a polymer component B consisting of an acrylic polymer, which had a composition of AN:-MA:SMAS=89.0:10.5:0.5(%), were separately dissolved in DMF to prepare spinning solutions A and B containing 23% of the polymer components A and B, respectively. The spinning solutions A and B were extruded from a spinneret in a conjugate ratio (weight ratio) of component A/component B of 5/5 and in a side-by-side relation into a coagulation bath consisting of a 56% DMF aqueous solution kept at 20° C. The extruded filaments were subjected to a primary drawing in a draw ratio shown in the following Table 15. The primarily drawn filaments were washed with water, dried by means of a hot roller type drier kept at 125° C. until the water content of the filaments were decreased to 0.7%, and then subjected to a secondary drawing at 115° C. under wet heat to draw the filaments to 1.4 times their original length. The secondarily drawn filaments were mechanically crimped, and the crimps were set to obtain a composite fiber having latent crimpability. Properties of the resulting composite fibers are shown in Table 15.

TABLE 15

| Experiment number | Draw ratio in primary drawing | Fiber property: Water absorption (%) | Fiber property: Dyeability | Fiber property: Others | Operability | Remarks |
|---|---|---|---|---|---|---|
| 166 | 2 | 39.7 | poor | whitening | yarn breakage occurs often after drying | Comparative sample |
| 167 | 2.5 | 39.4 | substantially | somewhat | | Present |

TABLE 15-continued

| Experiment number | Draw ratio in primary drawing | Fiber property: Water absorption (%) | Dyeability | Others | Operability | Remarks |
|---|---|---|---|---|---|---|
| | | | good | whitening | | invention |
| 168 | 3 | 37.5 | good | good yarn property | good crimp developing property | Present invention |
| 169 | 4 | 35.6 | good | good yarn property | good crimp developing property | Present invention |
| 170 | 6 | 36.7 | good | good yarn property | good crimp developing property | Present invention |
| 171 | 8 | 35.3 | good | good yarn property | good crimp developing property | Present invention |
| 172 | 9 | 24.7 | good | good yarn property | yarn breakage occurs often during the primary drawing | Comparative sample |
| 173 | 10 | 16.5 | somewhat poor | uneven luster | yarn breakage occurs often during the primary drawing | Comparative sample |

EXAMPLE 17

A polymer component A consisting of 70 parts of an acrylic polymer, which had a composition of AN:MA:SMAS=90.6:9.0:0.4(%), and 30 parts of cellulose acetate, and a polymer component B consisting of the same acrylic polymer as used in the polymer component A, which had a composition of AN:MA:SMAS=90.6:9.0:0.4(%), was dissolved in DMF to prepare spinning solutions A and B containing 25% of the polymer components A and B, respectively. The spinning solutions A and B were extruded from a spinneret in a conjugate ratio (weight ratio) of component A/component B of 5/5 and in a side-by-side relation into a coagulation bath consisting of a 60% DMF aqueous solution kept at 25° C. The extruded filaments were subjected to a primary drawing to draw the filaments to 4 times their original length. The primarily drawn filaments were washed with water, dried by means of a hot roller type drier kept at a temperature shown in the following Table 16 until the water content of the filaments was decreased to not more than 0.8%, and then subjected to a secondary drawing at 105° C. under wet heat to draw the filaments to 1.6 times their original length. The secondarily drawn filaments were mechanically crimped, and the crimps were set to obtain 3-denier composite fibers. Properties of the fibers are shown in Table 16.

TABLE 16

| Experiment number | Drying temperature (°C.) | Void: Porosity ($cm^3/g$) | Void: Surface area ($m^2/g$) | Fiber property: Water absorption (%) | Dyeability | Others | Remarks |
|---|---|---|---|---|---|---|---|
| 174 | 60 | 0.56 | 19.4 | 58 | poor | yarn property is poor and fiber is whitened | Comparative sample |
| 175 | 80 | 0.51 | 16.3 | 53 | poor | yarn property is poor and fiber is whitened | Comparative sample |
| 176 | 100 | 0.46 | 6.88 | 49 | somewhat poor | | Present invention |
| 177 | 120 | 0.42 | 1.57 | 46 | good | | Present invention |
| 178 | 140 | 0.37 | 1.43 | 40 | good | | Present invention |
| 179 | 160 | 0.31 | 1.36 | 34 | good | | Present invention |
| 180 | 180 | 0.26 | 1.14 | 27 | good | fiber somewhat colors | Present invention |
| 181 | 190 | 0.21 | 1.05 | 24 | good | fiber colors and becomes rigid | Comparative sample |
| 182 | 200 | 0.18 | 0.91 | 22 | somewhat poor | fiber colors and becomes rigid | Comparative sample |

EXAMPLE 18

The same water washed filament tows as those obtained in Example 17, which had been swollen with water, were dried by means of a hot roller type drier kept at 120° C. until the water content of the tows were decreased to various water contents shown in the following Table 17, and the dried tows were treated under the same after-treatment condition as described in Example 17 to obtain 3-denier fibers. Properties of the fibers are shown in Table 17.

TABLE 17

| Experiment number | Water content (%) | Void: Porosity ($cm^3/g$) | Void: Surface area ($m^2/g$) | Fiber property: Water absorption (%) | Dyeability | Others | Remarks |
|---|---|---|---|---|---|---|---|
| 183 | 0.1 | 0.37 | 1.28 | 40 | good | | Present invention |
| 184 | 0.3 | 0.39 | 1.41 | 42 | good | | Present |

TABLE 17-continued

| Experiment number | Water content (%) | Void: Porosity ($cm^3/g$) | Void: Surface area ($m^2/g$) | Fiber property: Water absorption (%) | Fiber property: Dyeability | Fiber property: Others | Remarks |
|---|---|---|---|---|---|---|---|
| | | | | | | | invention |
| 185 | 0.5 | 0.38 | 1.34 | 41 | good | | Present invention |
| 186 | 0.7 | 0.41 | 1.49 | 43 | good | | Present invention |
| 187 | 1.0 | 0.43 | 2.48 | 45 | good | | Present invention |
| 188 | 1.1 | 0.53 | 5.69 | 54 | somewhat poor | uneven luster and uneven yarn property | Comparative sample |
| 189 | 1.5 | 0.76 | 13.7 | 78 | poor | uneven luster and uneven yarn property | Comparative sample |
| 190 | 2.0 | 0.89 | 16.4 | 89 | poor | uneven luster and uneven yarn property | Comparative sample |
| 191 | 5.0 | 1.30 | 23.1 | 126 | poor | uneven luster and uneven yarn property | Comparative sample |

EXAMPLE 19

A polymer component A consisting of 70 parts of an acrylic polymer, which had a composition of AN:MA:SMAS=92.5:7.0:0.5(%), and 30 parts of cellulose acetate, and a polymer component B consisting of an acrylic polymer, which had a composition of AN:MA:SMAS=90.5:9.0:0.5(%), were separately dissolved in DMF to prepare spinning solutions A and B containing 25% of the polymer components A and B, respectively. The spinning solutions A and B were extruded from a spinneret in a conjugate ratio (weight ratio) of component A/component B of 5/5 and in a side-by-side relation into a coagulation bath consisting of a 60% DMF aqueous solution kept at 18° C. The extruded filaments were subjected to a primary drawing to draw the filaments to 5 times their original length. The primarily drawn filaments were washed with water, dried by means of a hot roller type drier kept at 120° C. while blowing hot air kept at 130° C. until the water content of the filaments was decreased to 0.7%, and then subjected to a secondary drawing under a condition shown in the following Table 18. The secondarily drawn filaments were mechanically crimped, and the crimps were set to obtain composite fibers having a latent crimpability. Properties of the fibers are shown in Table 18.

TABLE 18(a)

| Experiment number | Secondary drawing condition: Temperature (°C.) | Secondary drawing condition: Draw ratio | Fiber property: Water absorption (%) | Fiber property: Dyeability | Fiber property: Others | Operability | Remarks |
|---|---|---|---|---|---|---|---|
| 192 | 100 | 0.9 | 39 | good | good luster | good | Present invention |
| 193 | 100 | 1.0 | 43 | good | good luster | good | Present invention |
| 194 | 100 | 1.5 | 41 | good | good luster | good | Present invention |
| 195 | 100 | 2 | 36 | good | good luster | good | Present invention |
| 196 | 100 | 3 | 31 | somewhat poor | somewhat poor in luster and in yarn property | some yarn breakage | Present invention |
| 197 | 110 | 0.9 | 44 | good | good luster | good | Present invention |
| 198 | 110 | 1.0 | 45 | good | good luster | good | Present invention |
| 199 | 110 | 1.5 | 41 | good | good luster | good | Present invention |

TABLE 18(b)

| Experiment number | Secondary drawing condition: Temperature (°C.) | Secondary drawing condition: Draw ratio | Fiber property: Water absorption (%) | Fiber property: Dyeability | Fiber property: Others | Operability | Remarks |
|---|---|---|---|---|---|---|---|
| 200 | 110 | 2 | 38 | good | good luster | good | Present invention |
| 201 | 110 | 3 | 31 | somewhat poor | somewhat poor in luster and in yarn property | some yarn breakage | Present invention |
| 202 | 110 | 4 | — | — | — | frequent yarn breakage and poor operability | Comparative sample |
| 203 | 120 | 0.85 | 35 | good | good luster | good | Present invention |

TABLE 18(b)-continued

| Experiment number | Secondary drawing condition: Temperature (°C.) | Secondary drawing condition: Draw ratio | Fiber property: Water absorption (%) | Fiber property: Dyeability | Fiber property: Others | Operability | Remarks |
|---|---|---|---|---|---|---|---|
| 204 | 120 | 1.0 | 41 | good | good luster | good | Present invention |
| 205 | 120 | 2 | 36 | good | good luster | good | Present invention |

TABLE 18(c)

| Experiment number | Secondary drawing condition: Temperature (°C.) | Secondary drawing condition: Draw ratio | Fiber property: Water absorption (%) | Fiber property: Dyeability | Fiber property: Others | Operability | Remarks |
|---|---|---|---|---|---|---|---|
| 206 | 120 | 3 | 29 | somewhat poor | somewhat poor in luster and in yarn property | some yarn breakage | Present invention |
| 207 | 120 | 4 | 18 | somewhat poor | somewhat poor in luster and in yarn property | frequent yarn breakage | Comparative sample |
| 208 | 130 | 0.8 | 33 | good | good luster | good | Present invention |
| 209 | 130 | 1.0 | 35 | good | good luster | good | Present invention |
| 210 | 130 | 2 | 31 | good | good luster | good | Present invention |
| 211 | 130 | 3 | 25 | somewhat poor | somewhat poor in luster and in yarn property | some yarn breakage | Present invention |
| 212 | 130 | 4 | 16 | somewhat poor | somewhat poor in luster and in yarn property | frequent yarn breakage | Comparative sample |

EXAMPLE 20

A polymer component A consisting of (100-C) parts of an acrylic polymer, which had a composition of AN:MA:SMAS=(99.5-x):x:0.5(%), and C parts of cellulose acetate, and a polymer component B consisting of an acrylic polymer, which had a composition of AN:MA:SMAS=(99.5-y):y:0.5(%), were separately dissolved in DMF to prepare spinning solutions A and B containing 23% of the polymer components A and B, respectively. The spinning solutions A and B were extruded from a spinneret in a conjugate ratio (weight ratio) of component A/component B of 5/5 and in a side-by-side relation into a coagulation bath consisting of a 56% DMF aqueous solution kept at 15° C. The extruded filaments were subjected to a primary drawing to draw the filaments to 4 times their original length. The primarily drawn filaments were washed with water, dried by means of a hot roller type drier kept at 125° C. until the water content of the filaments was decreased to 0.5%, and subjected to a secondary drawing at 115° C. under wet heat to draw the filaments to 1.3 times their original length, and the secondarily drawn filaments were subjected to a primary shrinking at 130° C. under wet heat to shrink the filaments to 0.9 time their original length.

Then, in order to improve the crimpability of the filaments, the above treated filaments were further subjected to a tertiary drawing at 180° C. under dry heat to draw the filaments to 1.4 times their original length, and the above drawn filaments were subjected to a secondary shrinking at 150° C. under dry heat to shrink the filaments to 0.9 times their original length. Then, the above treated filaments were mechanically crimped, and the crimps were set to obtain 3-denier composite fibers having a latent crimpability. The composite fiber obtained in the present invention has substantially the same crimpability as that of comparative sample and further has improved dyeability and water-absorbing property. Properties of the above obtained fibers are shown in the following Table 19.

TABLE 19

| Experiment number | Polymer component: Component A x (%) | Polymer component: Component A C (parts) | Polymer component: Component B y (%) | Fiber property: Water absorption (%) | Fiber property: Dyeability | Fiber property: Crimpability | Remarks |
|---|---|---|---|---|---|---|---|
| 213 | 7 | 10 | 9 | 24 | good | good | Present invention |
| 214 | 7 | 20 | 9 | 31 | good | good | Present invention |
| 215 | 7 | 30 | 9 | 35 | good | good | Present invention |
| 216 | 10 | 10 | 8 | 21 | good | good | Present invention |
| 217 | 10 | 20 | 8 | 29 | good | good | Present invention |

TABLE 19-continued

| Experiment number | Polymer component: Component A x (%) | Component A C (parts) | Component B y (%) | Fiber property: Water absorption (%) | Dyeability | Crimpability | Remarks |
|---|---|---|---|---|---|---|---|
| 218 | 10 | 30 | 8 | 34 | good | good | Present invention |
| 219 | 7 | 0 | 9 | 4 | good | good | Comparative sample |
| 220 | 10 | 0 | 8 | 4 | good | good | Comparative sample |

EXAMPLE 21

A polymer component A consisting of 70 parts of an acrylic polymer, which had a composition of AN:MA:SMAS=91.5:8.0:0.5(%), 30 parts of cellulose acetate and 10 parts of an acrylic copolymer having a composition of AN:$CH_2$=CHCOO-(-$CH_2CH_2O$-)$_{20}$H=90:10(%), and a component polymer B consisting of an acrylic polymer, which had a composition of AN:MA:SMAS=89.5:10.0:0.5(%), were separately dissolved in DMF to prepare spinning solutions A and B containing 23% of the polymer components A and B, respectively. The spinning solutions A and B were conjugate spun in a conjugate ratio (weight ratio) of component A/component B of 5/5. The spinning and the after-treatment were effected under the same spinning and after-treatment conditions as described in Example 20 to obtain 3-denier composite fibers having a latent crimpability.

The resulting composite fiber had a porosity of 0.20 $cm^3/g$, a surface area of voids of 1.13 $m^2/g$ and a water absorption of 27%. In the fiber, crimps were able to be easily developed by treating the fibers with boiling water at 100° C. for 5 minutes. The crimped fiber had a strength of 2.7 g/d, an elongation of 32.3%, a number of crimps of 32 per inch of fiber, a percentage crimp of 46%, an elastic recovery of crimp of 74% and a residual percentage crimp of 34%, and further had an excellent bulkiness.

EXAMPLE 22

A polymer component A consisting of (100-$C_1$) parts of an acrylic polymer, which had a composition of AN:MA:SMAS=92.4:7.0:0.6(%), and $C_1$ parts of cellulose acetate was dissolved in DMF to prepare a spinning solution A consisting of 23% of the polymer component A. A polymer component B consisting of (100-$C_2$) parts of an acrylic polymer, which had a composition of AN:MA:SMAS=90.4:9.0:0.6(%), and $C_2$ parts of cellulose acetate was dissolved in DMF to prepare a spinning solution B containing 23% of the polymer component B. The spinning solutions A and B were extruded from a spinneret in a conjugate ratio of component A/component B of 1:1 and in a side-by-side relation into a coagulation bath consisting of a 56% DMF aqueous solution kept at 16° C. The extruded filaments were subjected to a primary drawing to draw the filaments to 4 times their original length, washed with water and then dried by means of a hot roller type drier kept at 125° C. until the water content of the filaments was decreased to 0.7%. The dried filaments were subjected to a secondary drawing at 110° C. under wet heat to draw the filaments to 1.6 times their original length, the secondarily drawn filaments were subjected to a primary shrinking at 125° C. under wet heat to shrink the filaments to 0.9 time their original length, the primarily shrunk filaments were subjected to a tertiary drawing at 180° C. under dry heat to draw the filaments to 1.4 times their original length, and then the drawn filaments were subjected to a secondary shrinking at 150° C. under dry heat to shrink the filaments to 0.9 times their original length. The above treated filaments were mechanically crimped and the crimps were set to obtain composite fibers having a latent crimpability. Properties of the composite fibers are shown in the following Table 20.

TABLE 20(a)

| Experiment number | Polymer component: $C_1$ (parts) | $C_2$ (parts) | Void: Porosity ($cm^3/g$) | Surface area ($m^2/g$) | Fiber property: Water absorption (%) | Dyeability | Others | Remarks |
|---|---|---|---|---|---|---|---|---|
| 221 | 2 | 2 | 0.105 | 1.35 | 14 | good | | Present invention |
| 222 | 2 | 10 | 0.231 | 1.62 | 26 | good | | Present invention |
| 223 | 2 | 20 | 0.294 | 1.84 | 33 | good | | Present invention |
| 224 | 2 | 30 | 0.357 | 2.01 | 38 | good | | Present invention |
| 225 | 2 | 50 | 0.731 | 2.56 | 77 | somewhat poor | somewhat poor in strength and in elongation | Present invention |
| 226 | 2 | 60 | 0.945 | 2.94 | 94 | poor | poor in strength and in elongation | Comparative sample |
| 227 | 10 | 2 | 0.245 | 1.43 | 27 | good | | Present invention |
| 228 | 10 | 10 | 0.357 | 1.76 | 38 | good | | Present invention |
| 229 | 10 | 30 | 0.483 | 1.89 | 50 | good | | Present invention |

TABLE 20(b)

| Experiment number | Polymer component $C_1$ (parts) | Polymer component $C_2$ (parts) | Void: Porosity ($cm^3/g$) | Void: Surface area ($m^2/g$) | Fiber property: Water absorption (%) | Fiber property: Dyeability | Fiber property: Others | Remarks |
|---|---|---|---|---|---|---|---|---|
| 230 | 10 | 50 | 0.851 | 1.91 | 84 | somewhat poor | poor in strength and in elongation | Comparative sample |
| 231 | 30 | 10 | 0.473 | 1.94 | 49 | good | | Present invention |
| 232 | 30 | 30 | 0.578 | 2.57 | 60 | somewhat poor | somewhat poor in strength and in elongation | Present invention |
| 233 | 30 | 50 | 0.945 | 3.48 | 100 | poor | poor in strength and in elongation | Comparative sample |
| 234 | 2 | 10 | 0.231 | 1.62 | 25 | good | | Present invention |
| 235 | 10 | 10 | 0.353 | 1.75 | 39 | good | | Present invention |
| 236 | 30 | 10 | 0.476 | 1.94 | 51 | good | | Present invention |
| 237 | 50 | 10 | 0.735 | 2.41 | 74 | somewhat poor | somewhat poor in strength and in elongation | Present invention |

TABLE 20(c)

| Experiment number | Polymer component $C_1$ (parts) | Polymer component $C_2$ (parts) | Void: Porosity ($cm^3/g$) | Void: Surface area ($m^2/g$) | Fiber property: Water absorption (%) | Fiber property: Dyeability | Fiber property: Others | Remarks |
|---|---|---|---|---|---|---|---|---|
| 238 | 60 | 10 | 1.007 | 2.98 | 117 | poor | poor in strength and in elongation | Comparative sample |
| 239 | 2 | 30 | 0.315 | 1.88 | 33 | good | | Present invention |
| 240 | 10 | 30 | 0.469 | 1.93 | 49 | good | | Present invention |
| 241 | 30 | 30 | 0.563 | 2.57 | 58 | somewhat poor | somewhat poor in strength and in elongation | Present invention |
| 242 | 50 | 30 | 0.913 | 3.49 | 92 | poor | poor in strength and in elongation | Comparative sample |

EXAMPLE 23

A polymer component A consisting of (100-$C_1$) parts of an acrylic polymer, which had a composition of AN:MA:SMAS=92.4:7.0:0.6(%), and $C_1$ parts of cellulose acetate was dissolved in DMF to prepare a spinning solution A containing 23% of the polymer component A. A polymer component B consisting of (100-$C_2$) parts of an acrylic copolymer, which had a composition of AN:MA:SMAS=89.4:10.0:0.6(%), and $C_2$ parts of cellulose acetate was dissolved in DMF to prepare a spinning solution B containing 23% of the polymer component B. The spinning solutions A and B were extruded from a spinneret in various conjugate ratios (weight ratio of component A/component B) shown in the following Table 21 and in a side-by-side relation into a coagulation bath consisting of a 56% DMF aqueous solution kept at 16° C. The spinning, drawing and after-treatment were carried out under the same conditions as described in Example 22 to obtain 3-denier composite fibers having a latent crimpability. The fibers were treated in hot water kept at 100° C. for 5 minutes to develop crimps. Properties of the fibers are shown in Table 21.

TABLE 21(a)

| Experiment number | Polymer component $C_1$ (parts) | Polymer component $C_2$ (parts) | Conjugate ratio A/B | Void Porosity ($cm^3/g$) | Fiber property: Water absorption (%) | Fiber property: Number of crimps/inch | Remarks |
|---|---|---|---|---|---|---|---|
| 243 | 2 | 28 | 8/2 | 0.205 | 23 | 11 | Comparative sample |
| 244 | 2 | 28 | 7/3 | 0.221 | 25 | 23 | Present invention |
| 245 | 2 | 28 | 6/4 | 0.293 | 33 | 44 | Present invention |
| 246 | 2 | 28 | 5/5 | 0.339 | 35 | 52 | Present invention |
| 247 | 2 | 28 | 4/6 | 0.374 | 39 | 48 | Present invention |
| 248 | 2 | 28 | 3/7 | 0.416 | 44 | 29 | Present invention |
| 249 | 2 | 28 | 2/8 | 0.473 | 49 | 13 | Comparative sample |
| 250 | 7 | 23 | 8/2 | 0.320 | 35 | 14 | Comparative |

TABLE 21(a)-continued

| Experiment number | Polymer component $C_1$ (parts) | Polymer component $C_2$ (parts) | Conjugate ratio A/B | Void Porosity ($cm^3/g$) | Fiber property: Water absorption (%) | Fiber property: Number of crimps/inch | Remarks |
|---|---|---|---|---|---|---|---|
| | | | | | | | sample |
| 251 | 7 | 23 | 7/3 | 0.343 | 34 | 25 | Present invention |
| 252 | 7 | 23 | 6/4 | 0.364 | 38 | 48 | Present invention |
| 253 | 7 | 23 | 5/5 | 0.381 | 41 | 61 | Present invention |
| 254 | 7 | 23 | 4/6 | 0.409 | 43 | 50 | Present invention |
| 255 | 7 | 23 | 3/7 | 0.429 | 45 | 31 | Present invention |

TABLE 21(b)

| Experiment number | Polymer component $C_1$ (parts) | Polymer component $C_2$ (parts) | Conjugate ratio A/B | Void Porosity ($cm^3/g$) | Fiber property: Water absorption (%) | Fiber property: Number of crimps/inch | Remarks |
|---|---|---|---|---|---|---|---|
| 256 | 7 | 23 | 2/8 | 0.453 | 48 | 17 | Comparative sample |
| 257 | 15 | 15 | 8/2 | 0.403 | 41 | 13 | Comparative sample |
| 258 | 15 | 15 | 7/3 | 0.414 | 43 | 25 | Present invention |
| 259 | 15 | 15 | 5/5 | 0.404 | 45 | 54 | Present invention |
| 260 | 15 | 15 | 3/7 | 0.407 | 41 | 29 | Present invention |
| 261 | 15 | 15 | 2/8 | 0.409 | 43 | 16 | Comparative sample |
| 262 | 10 | 10 | 8/2 | 0.357 | 37 | 15 | Comparative sample |
| 263 | 10 | 10 | 7/3 | 0.363 | 39 | 26 | Present invention |
| 264 | 10 | 10 | 6/4 | 0.351 | 36 | 47 | Present invention |
| 265 | 10 | 10 | 5/5 | 0.349 | 37 | 58 | Present invention |
| 266 | 10 | 10 | 4/6 | 0.353 | 38 | 51 | Present invention |
| 267 | 10 | 10 | 3/7 | 0.364 | 38 | 34 | Present invention |
| 268 | 10 | 10 | 2/8 | 0.358 | 37 | 17 | Comparative sample |

EXAMPLE 24

A polymer component A consisting of 90 parts of an acrylic polymer, which had a composition of AN:(M-1):SMAS=(99.5-x):x:0.5(%), and 10 parts of cellulose acetate, and a polymer component B consisting of 90 parts of an acrylic copolymer, which had a composition of AN:(M-2):SMAS=(99.5-y):y:0.5(%), and 10 parts of cellulose acetate were separately dissolved in DMF to prepare spinning solutions A and B containing 25% of the polymer components A and B, respectively. The spinning solutions A and B were extruded from a spinneret in a conjugate ratio (weight ratio of component A/component B) of 5/5 and in a side-by-side relation into a coagulation bath consisting of a 56% DMF aqueous solution kept at 20° C. The extruded filaments were subjected to a primary drawing to draw the filaments to 5 times their original length, washed with water, and then dried by means of a hot roller type drier kept at 125° C. until the water content of the filaments was decreased to not more than 0.7%. After the drying, the dried filaments were treated under the same conditions as described in Example 22 to obtain 3-denier composite fibers having a latent crimpability. The fibers were treated in hot water kept at 100° C. for 5 minutes to develop crimps.

Properties of the fibers are shown in the following Table 22.

TABLE 22(a)

| Experiment number | Polymer component: Polymer A M-1 | Polymer A x (%) | Polymer B M-2 | Polymer B y (%) | Void Porosity ($cm^3/g$) | Fiber property: Water absorption (%) | Fiber property: Number of crimps/inch | Fiber property: Crimpability | Remarks |
|---|---|---|---|---|---|---|---|---|---|
| 269 | methyl acrylate | 5 | methyl acrylate | 6 | 0.347 | 36 | 13 | poor | Comparative sample |
| 270 | methyl acrylate | 5 | methyl acrylate | 6.5 | 0.349 | 37 | 16 | poor | Comparative sample |

TABLE 22(a)-continued

| Experiment number | Polymer component: Polymer A M-1 | x (%) | Polymer B M-2 | y (%) | Void Porosity ($cm^3/g$) | Fiber property: Water absorption (%) | Number of crimps/inch | Crimpability | Remarks |
|---|---|---|---|---|---|---|---|---|---|
| 271 | methyl acrylate | 5 | methyl acrylate | 7 | 0.351 | 37 | 34 | high | Present invention |
| 272 | methyl acrylate | 5 | methyl acrylate | 7.5 | 0.356 | 38 | 47 | high | Present invention |
| 273 | methyl acrylate | 5 | methyl acrylate | 8 | 0.371 | 40 | 53 | high | Present invention |
| 274 | methyl acrylate | 6 | methyl acrylate | 7 | 0.353 | 36 | 11 | poor | Comparative sample |
| 275 | methyl acrylate | 6 | methyl acrylate | 7.5 | 0.355 | 37 | 15 | poor | Comparative sample |
| 276 | methyl acrylate | 6 | methyl acrylate | 8 | 0.361 | 36 | 28 | high | Present invention |
| 277 | methyl acrylate | 6 | methyl acrylate | 8.5 | 0.367 | 39 | 39 | high | Present invention |
| 278 | methyl acrylate | 6 | methyl acrylate | 9 | 0.371 | 39 | 47 | high | Present invention |

TABLE 22(b)

| Experiment number | Polymer component: Polymer A M-1 | x (%) | Polymer B M-2 | y (%) | Void Porosity ($cm^3/g$) | Fiber property: Water absorption (%) | Number of crimps/inch | Crimpability | Remarks |
|---|---|---|---|---|---|---|---|---|---|
| 279 | methyl acrylate | 7 | methyl acrylate | 8 | 0.357 | 38 | 12 | poor | Comparative sample |
| 280 | methyl acrylate | 7 | methyl acrylate | 8.5 | 0.363 | 38 | 17 | poor | Comparative sample |
| 281 | methyl acrylate | 7 | methyl acrylate | 9 | 0.361 | 38 | 31 | high | Present invention |
| 282 | methyl acrylate | 7 | methyl acrylate | 9.5 | 0.371 | 39 | 43 | high | Present invention |
| 283 | methyl acrylate | 7 | methyl acrylate | 10 | 0.365 | 38 | 54 | high | Present invention |
| 284 | methyl acrylate | 9 | methyl acrylate | 10.5 | 0.351 | 37 | 16 | poor | Comparative sample |
| 285 | methyl acrylate | 9 | methyl acrylate | 11 | 0.353 | 37 | 31 | high | Present invention |
| 286 | methyl acrylate | 9 | methyl acrylate | 12 | 0.347 | 36 | 45 | high | Present invention |

TABLE 22(c)

| Experiment number | Polymer component: Polymer A M-1 | x (%) | Polymer B M-2 | y (%) | Void Porosity ($cm^3/g$) | Fiber property: Water absorption (%) | Number of crimps/inch | Crimpability | Remarks |
|---|---|---|---|---|---|---|---|---|---|
| 287 | methyl acrylate | 10 | methyl acrylate | 11.5 | 0.341 | 36 | 14 | poor | Comparative sample |
| 288 | methyl acrylate | 10 | methyl acrylate | 12 | 0.337 | 35 | 29 | high | Present invention |
| 289 | methyl acrylate | 10 | methyl acrylate | 13 | 0.329 | 34 | 41 | high | Present invention |
| 290 | methyl acrylate | 10 | methyl acrylate | 14 | 0.325 | 34 | 56 | high | Present invention |
| 291 | vinyl acetate | 9 | vinyl acetate | 10 | 0.374 | 39 | 11 | poor | Comparative sample |
| 292 | vinyl acetate | 9 | vinyl acetate | 10.5 | 0.377 | 41 | 17 | poor | Comparative sample |
| 293 | vinyl acetate | 9 | vinyl acetate | 11.0 | 0.383 | 40 | 28 | high | Present invention |
| 294 | vinyl acetate | 9 | vinyl acetate | 11.5 | 0.371 | 39 | 37 | high | Present invention |
| 295 | vinyl acetate | 9 | vinyl acetate | 12.0 | 0.363 | 38 | 49 | high | Present invention |
| 296 | vinyl acetate | 9 | vinyl acetate | 12.5 | 0.358 | 37 | 56 | high | Present invention |

TABLE 22(d)

| Experiment number | Polymer component: Polymer A M-1 | x (%) | Polymer B M-2 | y (%) | Void Porosity ($cm^3/g$) | Fiber property: Water absorption (%) | Number of crimps/inch | Crimpability | Remarks |
|---|---|---|---|---|---|---|---|---|---|
| 297 | a mixture of 7% of methyl acrylate and 1% of acrylamide | 8 | a mixture of 7% of methyl acrylate and acrylamide* | 9(2*) | 0.293 | 31 | 12 | poor | Comparative Sample |
| 298 | a mixture of 7% of methyl acrylate and 1% of acrylamide | 8 | a mixture of 7% of methyl acrylate and acrylamide* | 9.5(2.5) | 0.279 | 30 | 19 | poor | Comparative Sample |
| 299 | a mixture of 7% of methyl acrylate and 1% of acrylamide | 8 | a mixture of 7% of methyl acrylate and acrylamide* | 10 (3.0) | 0.237 | 27 | 31 | high | Present invention |
| 300 | a mixture of 7% of methyl acrylate and 1% of acrylamide | 8 | a mixture of 7% of methyl acrylate and acrylamide* | 10.5(3.5) | 0.231 | 25 | 43 | high | Present invention |
| 301 | a mixture of 7% of methyl acrylate and 1% of acrylamide | 8 | a mixture of 7% of methyl acrylate and acrylamide* | 11 (4.0) | 0.245 | 26 | 51 | high | Present invention |
| 302 | methyl acrylate | 7 | 2-hydroxyethyl methacrylate | 9 | 0.349 | 37 | 13 | poor | Comparative sample |
| 303 | methyl acrylate | 7 | 2-hydroxyethyl methacrylate | 9.5 | 0.353 | 38 | 17 | poor | Comparative sample |
| 304 | methyl acrylate | 7 | 2-hydroxyethyl methacrylate | 10 | 0.358 | 39 | 28 | high | Present invention |
| 305 | methyl acrylate | 7 | 2-hydroxyethyl methacrylate | 11 | 0.361 | 40 | 41 | high | Present invention |

EXAMPLE 25

A polymer component A consisting of 85 parts of an acrylic polymer, which had a composition of AN:MA:SMAS=90.6:9.0:0.4(%), and 15 parts of cellulose acetate, and a polymer component B consisting of 85 parts of an acrylic polymer, which had a composition of AN:MA:SMAS=87.5:12.0:0.5(%), and 15 parts of cellulose acetate were separately dissolved in DMF to prepare spinning solutions A and B containing 23% of the polymer components A and B, respectively. The spinning solutions A and B were extruded from a spinneret in a conjugate ratio (weight ratio), of component A:component B of 5:5 and in a side-by-side relation into a coagulation bath consisting of a 65% DMF aqueous solution kept at 15° C. The extruded filaments were subjected to a primary drawing under the condition shown in the following Table 23, and washed with water. Then, the filaments were dried and after-treated under the same conditions as described in Example 22 to obtain composite fibers having a latent crimpability. Properties of the fibers are shown in Table 23.

TABLE 23

| Experiment number | Draw ratio in primary drawing | Void: Porosity ($cm^3/g$) | Surface area ($m^2/g$) | Fiber property: Water absorption (%) | Dyeability | Others | Operability | Remarks |
|---|---|---|---|---|---|---|---|---|
| 306 | 2 | 0.443 | 7.64 | 43 | somewhat poor | somewhat poor in strength and in elongation | dried yarn is brittle | Comparative sample |
| 307 | 2.5 | 0.435 | 4.35 | 45 | somewhat poor | somewhat poor in strength and in elongation | dried yarn is brittle | Present invention |
| 308 | 3 | 0.432 | 2.31 | 45 | good | | | Present invention |
| 309 | 4 | 0.411 | 2.08 | 43 | good | | | Present invention |
| 310 | 5 | 0.403 | 2.11 | 45 | good | | | Present invention |
| 311 | 6 | 0.387 | 2.14 | 39 | good | | | Present invention |
| 312 | 7 | 0.374 | 2.31 | 39 | good | | | Present invention |
| 313 | 8 | 0.351 | 2.05 | 37 | good | | | Present |

TABLE 23-continued

| Experiment number | Draw ratio in primary drawing | Void: Porosity ($cm^3/g$) | Void: Surface area ($m^2/g$) | Fiber property: Water absorption (%) | Fiber property: Dyeability | Fiber property: Others | Operability | Remarks |
|---|---|---|---|---|---|---|---|---|
| | | | | | | | | invention |
| 314 | 9 | 0.330 | 1.88 | 35 | good | | yarn breakage occurs often during spinning | Comparative sample |
| 315 | 10 | 0.289 | 1.74 | 31 | good | | yarn breakage occurs often during spinning | Comparative sample |

EXAMPLE 26

The same spinning solutions A and B as described in Example 25 were extruded from a spinneret in a conjugate ratio of component A:component B of 5:5 and in a side-by-side relation into a coagulation bath consisting of a 65% DMF aqueous solution kept at 15° C. The extruded filaments were subjected to a primary drawing to draw the filaments to 5 times their original length, washed with water and then dried at a drying temperature shown in the following Table 24 until the water content of the filaments was decreased to not more than 0.7%. The dried filaments were subjected to a secondary drawing and the successive after-treatments under the same conditions as described in Example 22 to obtain 3-denier composite fibers having a latent crimpability. Properties of the fibers are shown in Table 24.

TABLE 24

| Experiment number | Drying temperature (°C.) | Void: Porosity ($cm^3/g$) | Void: Surface area ($m^2/g$) | Fiber property: Water absorption (%) | Fiber property: Dyeability | Fiber property: Others | Remarks |
|---|---|---|---|---|---|---|---|
| 316 | 60 | 0.609 | 17.1 | 56 | poor | fiber is whitened and yarn property is poor | Comparative sample |
| 317 | 80 | 0.537 | 16.3 | 50 | poor | fiber is whitened and yarn property is poor | Comparative sample |
| 318 | 100 | 0.411 | 6.55 | 43 | somewhat poor | | Present invention |
| 319 | 120 | 0.403 | 2.11 | 45 | good | | Present invention |
| 320 | 140 | 0.389 | 1.74 | 42 | good | | Present invention |
| 321 | 160 | 0.381 | 1.57 | 41 | good | | Present invention |
| 322 | 180 | 0.368 | 1.35 | 39 | good | | Present invention |
| 323 | 190 | 0.346 | 1.38 | 37 | good | fiber is colored and becomes brittle | Comparative sample |
| 324 | 200 | 0.312 | 1.19 | 35 | somewhat poor | fiber is colored and becomes brittle | Comparative sample |

EXAMPLE 27

The same water-washed filament tows as those obtained in Example 26, which had been swollen with water, were dried by means of a hot roller type drier kept at 120° C. until the water content of the tows was decreased to various water contents shown in the following Table 25, and the dried tows were treated under the same after-treatment conditions as described in Example 26 to obtain 3-denier composite fibers having a latent crimpability. Properties of the fibers are shown in Table 25.

TABLE 25

| Experiment number | Water content (%) | Void: Porosity ($cm^3/g$) | Void: Surface area ($m^2/g$) | Fiber property: Water absorption (%) | Fiber property: Dyeability | Fiber property: Others | Remarks |
|---|---|---|---|---|---|---|---|
| 325 | 0.1 | 0.381 | 1.74 | 39 | good | | Present invention |
| 326 | 0.3 | 0.379 | 1.83 | 40 | good | | Present invention |
| 327 | 0.5 | 0.402 | 2.09 | 43 | good | | Present invention |
| 328 | 0.7 | 0.411 | 2.13 | 44 | good | | Present invention |
| 329 | 0.9 | 0.424 | 2.17 | 45 | good | | Present invention |
| 330 | 1.0 | 0.426 | 2.16 | 45 | good | | Present |

TABLE 25-continued

| Experiment number | Water content (%) | Void: Porosity ($cm^3/g$) | Void: Surface area ($m^2/g$) | Fiber property: Water absorption (%) | Fiber property: Dyeability | Fiber property: Others | Remarks |
|---|---|---|---|---|---|---|---|
| 331 | 1.5 | 0.473 | 9.31 | 50 | uneven | uneven in fineness and in yarn property | invention Comparative sample |
| 332 | 2.0 | 0.518 | 16.3 | 53 | uneven | uneven in fineness and in yarn property | Comparative sample |
| 333 | 5.0 | 0.780 | 20.5 | 71 | uneven | uneven in fineness and in yarn property | Comparative sample |

EXAMPLE 28

A polymer component A consisting of 80 parts of an acrylic polymer, which had a composition of AN:MA:SMAS=90.5:9.0:0.5(%), 20 parts of cellulose acetate and 10 parts of an acrylic copolymer, which consisted of AN and a comonomer represented by the formula of $CH_2{=}C(R_1){-}COO{-}(CH_2CH_2O)_l(CH_2CH(CH_3)O)_mR_2$ ($R_1$, $R_2$, l and m are shown in the following Table 26) in a weight ratio of AN:the comonomer of 90:10, and a polymer component B consisting of 90 parts of an acrylic polymer, which had a composition of AN:MA:SMAS=87.5:12.0:0.5(%), 10 parts of cellulose acetate and 5 parts of the above described acrylic copolymer consisting of AN and the comonomer in the same composition ratio as described above were separately dissolved in DMF to prepare spinning solutions A and B containing 25% of the polymer components A and B, respectively. The spinning solutions A and B were extruded from a spinneret in a conjugate ratio (weight ratio) of component A:component B of 5:5 and in a side-by-side relation into a coagulation bath consisting of a 65% DMF aqueous solution kept at 20° C. The extruded filaments were subjected to a primary drawing to draw the filaments to 5 times their original length, and the primarily drawn filaments were washed with water and then dried until the water content of the filaments was decreased to 0.5% by means of a hot roller type drier kept at 110° C., while blowing hot air kept at 130° C. Then, the above dried filaments were subjected to a secondary drawing to draw the filaments to 1.3 times their original length. Further, in order to improve the crimpability of the filaments, the secondarily drawn filaments were subjected to a primary shrinking at 130° C. under wet heat to shrink the filaments to 0.9 times their original length, the primarily shrunk filaments were subjected to a tertiary drawing at 170° C. under dry heat to draw the filaments to 1.4 times their original length and further the drawn filaments were subjected to a secondary shrinking at 140° C. under dry heat to shrink the filaments to 0.9 times their original length. The thus treated filaments were mechanically crimped, and the crimps were set to obtain 3-denier composite fibers having a latent crimpability. When the fibers were treated with boiling water kept at 100° C. for 5 minutes, crimps were able to be easily developed in the fibers. The following Table 26 shows the states of void and fiber properties, before and after crimps are developed, of the composite fibers obtained by varying $R_1$, $R_2$, l and m of the comonomer in the acrylic copolymer. It can be seen from Table 26 that all the above obtained composite fibers have excellent fiber property and water absorption.

TABLE 26

| Experiment number | Comonomer in acrylic copolymer: $R_1$ | $R_2$ | l | m | Before Crimping: Void: Porosity ($cm^3/g$) | Void: Surface area ($m^2/g$) | Fiber property: Water absorption (%) | Strength (g/d) | Elongation (%) | After Crimping: Void: Porosity ($cm^3/g$) | Void: Surface area ($m^2/g$) | Fiber property: Water absorption (%) | Crimp property: Number of crimps/inch | Percentage crimp (%) | Elastic recovery of crimp (%) | Residual percentage crimp (%) |
|---|---|---|---|---|---|---|---|---|---|---|---|---|---|---|---|---|
| 334 | H | H | 0 | 0 | 0.351 | 1.98 | 37 | 3.1 | 39 | 0.355 | 2.13 | 36 | 50 | 52 | 56 | 29 |
| 335 | H | H | 10 | 0 | 0.338 | 1.83 | 35 | 3.2 | 41 | 0.341 | 2.07 | 36 | 51 | 55 | 55 | 30 |
| 336 | H | H | 10 | 10 | 0.335 | 2.01 | 35 | 3.0 | 40 | 0.339 | 2.15 | 35 | 48 | 50 | 66 | 33 |
| 337 | $CH_3$ | H | 15 | 10 | 0.364 | 2.15 | 39 | 3.2 | 38 | 0.368 | 2.19 | 38 | 53 | 57 | 62 | 35 |
| 338 | $CH_3$ | $CH_3$ | 15 | 20 | 0.657 | 2.07 | 37 | 3.1 | 39 | 0.362 | 2.24 | 30 | 55 | 59 | 63 | 37 |

What is claimed is:

1. Porous acrylic synthetic fibers consisting of 2 to 30% by weight of cellulose acetate and 70 to 98% by weight of an acrylic polymer, the cellulose acetate being distributed in the acrylic polymer in an elongated form with the longest dimension thereof being parallel to the fiber axis, said synthetic fibers having substantially no microvoids, but having mainly macrovoids therein, and having a surface area A of voids of no greater than 15 $m^2/g$, a porosity V of 0.05 to 0.75 $cm^3/g$, and a V/A ratio of not less than 1/30.

2. The fibers as claimed in claim 1, wherein the acrylic polymer contains at least 80% by weight of acrylonitrile.

3. The fibers as claimed in claim 2, wherein the acrylic polymer contains 85 to 93% by weight of acrylonitrile.

4. The fibers as claimed in claim 1, wherein the acrylic polymer contains an acrylic copolymer containing 5 to 30% by weight of a monomer having the general formula $$CH_2=\overset{R_1}{\overset{|}{C}}-COOX$$

wherein X is $R_2$ or $$\text{+}CH_2-CH_2-O\text{+}_l(CH_2-\overset{CH_3}{\overset{|}{CH}}-O\text{+}_m-R_3,$$

$R_1$ and $R_3$ are H or $CH_3$, $R_2$ is H, $NH_4$ or an alkali metal, and l and m are integers of from 0 to 50 such that $0<l+m\leqq 50$, said acrylic copolymer being no greater than about 33% by weight based on the total acrylic polymer content of the acrylic synthetic fibers.

5. The fibers as claimed in claim 1, claim 2, claim 3 or claim 4, wherein said fibers have voids formed by phase separation of the acrylic polymer and cellulose acetate.

6. The fibers as claimed in claim 1, claim 2, claim 3 or claim 4, wherein the amount of cellulose acetate is 3 to 25% by weight.

7. The fibers as claimed in claim 6, wherein the amount cellulose acetate is from more than 10% by weight to 18% by weight.

8. The fibers as claimed in claim 1, claim 2 or claim 3, wherein the acrylic polymer contains 0.3 to 1.5% by weight of a copolymerizable monomer containing a sulfonic acid group.

9. The fibers as claimed in claim 8, wherein the amount of the copolymerizable monomer is 0.5 to 1.2% by weight.

10. The fibers as claimed in claim 8 or 9, wherein the copolymerizable monomer is sodium methallylsulfonate or sodium allylsulfonate.

11. The fibers as claimed in claim 1, wherein the content of microvoids in the porosity of the fibers is not greater than 30% by volume, said microvoids being voids having diameters of 2,000 Angstroms or less.

12. The fibers as claimed in claim 1, wherein the surface area A of the voids is from 0.02 to 10 $m^2/g$.

13. The fibers as claimed in claim 1, wherein the porosity V is from 0.05 to 0.60 $cm^3/g$.

14. The fibers as claimed in claim 1, wherein V/A is 1/20 or more.

15. A porous acrylic synthetic fiber consisting essentially of a blend of from 2 to 30% by weight of cellulose acetate and from 70 to 98% by weight of an acrylic polymer, said cellulose acetate having an acetic acid content of from 48 to 63% and an average polymerization degree of from 50 to 300, said acrylic polymer containing at least 80% by weight of acrylonitrile, from 0.3 to 1.5% by weight of allylsulfonic acid, methylallylsulfonic acid or salt thereof and the balance is monomer copolymerizable with acrylonitrile, said cellulose acetate being present in the form of elongated rods distributed in a matrix of said acrylic polymer so that the cellulose acetate rods are present in the fiber wall and in the interior of the cross section of the fiber, the longest dimension of said cellulose acetate rods extending parallel to the fiber axis and the ratio of length to diameter of said cellulose acetate rods being 10 or more, said cellulose acetate rods having voids at the circumferences thereof and in the interior thereof caused by phase separation of said cellulose acetate and said acrylic polymer, said voids consisting of not greater than 30% by volume of voids having a diameter of less than 2000 Angstroms and the remainder of said voids having a diameter of 2000 Angstroms or more, said fiber having a surface area A of said voids of not greater than 15 $m^2/g$, a porosity V of from 0.05 to 0.75 $cm^3/g$, and V/A being not less than 1/30.

16. A porous, acrylic, synthetic resin fiber, in which the polymeric component of said fiber consists of a mixture of (A) from 2 to 30% by weight of cellulose acetate, and (B) from 70 to 98% by weight of a polymer material selected from the group consisting of 1. acrylic polymer consisting of from (i) at least 80% by weight of acrylonitrile, and (ii) less than 20% by weight of monomer or monomers copolymerizable with acrylonitrile; and
2. mixture of said acylic polymer and an acrylic copolymer consisting of (i) from 5 to 30% by weight of monomer having the formula $$CH_2=\overset{R_1}{\overset{|}{C}}-COOX$$

wherein $R_1$ is H or $CH_3$, X is selected from the group consisting of H, $NH_4$, alkali metal and $$\text{+}CH_2-CH_2-O\text{+}_l\text{+}CH_2-\overset{CH_3}{\overset{|}{CH}}-O\text{+}_m-R_3$$

wherein $R_3$ is H or $CH_3$, and l and m are integers of from 0 to 50 and $0<l+m\leqq 50$, (ii) at least 70% by weight of acrylonitrile and (iii) the balance is said copolymerizable monomer, with the proviso that the amount of said acrylic copolymer is not greater than 33% by weight, based on the total weight of said polymeric component of said fiber, said fiber having a surface area A of voids of not greater than 15 $m^2/g$, a porosity V of from 0.05 to 0.75 $cm^3/g$ and the ratio of $$\frac{\text{porosity } V}{\text{surface area } A}$$

being 1/30 or more, said cellulose acetate being distributed in said acrylic polymer in the form of elongated rods having the longest dimension parallel to the fiber axis, said fiber having mainly macrovoids formed by phase separation of said cellulose acetate and said acrylic polymer.

17. The fiber as claimed in claim 16 in which said polymer material (B) consists of said acrylic polymer.

18. The fiber as claimed in claim 16 in which said polymer material (B) consists of said mixture of said acrylic polymer and said acrylic copolymer.

19. The fiber as claimed in claim 16, claim 17 or claim 18, containing from 3 to 25% by weight of cellulose acetate.

20. The fiber as claimed in claim 16, claim 17 or claim 18, containing from more than 10 to 18% by weight of cellulose acetate.

21. The fiber as claimed in claim 16, claim 17 or claim 18, in which said acrylic polymer contains from 85 to 93% by weight of acrylonitrile.

22. The fiber as claimed in claim 16, claim 17 or claim 18, in which said acrylic polymer contains from 0.3 to 1.5% by weight of a copolymerizable monomer containing a sulfonic acid group.

23. The fiber as claimed in claim 22 in which said copolymerizable monomer is sodium methallysulfonate or sodium allyl sulfonate.

24. The fiber as claimed in claim 21 in which said acrylic polymer contains from 0.5 to 1.2% by weight of a copolymerizable monomer selected from the group consisting of sodium methallylsulfonate and sodium allyl sulfonate.

25. The fiber as claimed in claim 16, claim 17 or claim 18, in which the content of microvoids having diameters of 2000 Angstroms or less is not greater than 30% by volume, based on the total volume of voids in the fiber.

26. The fiber as claimed in claim 16, claim 17 or claim 18, in which the surface area of the voids is from 0.02 to 10 $m^2/g$.

27. The fiber as claimed in claim 26, in which the porosity V is from 0.05 to 0.60 $cm^3/g$.

28. The fiber as claimed in claim 27 in which V/A is 1/20 or more.

29. The fiber as claimed in claim 16, claim 17 or claim 18 in which the celluloe acetate is present on the fiber wall and in the interior portion of the fiber so that intercommunicating macrovoids are present on the fiber wall and in the interior portion of the fibers.

30. The fiber as claimed in claim 29 in which at least 70 volume % of the voids in the fiber are macrovoids having a diameter of greater than 2000 Angstroms.

31. The fiber as claimed in claim 16, claim 17 or claim 18 in which said monomer or monomers copolymerizable with acrylonitrile are selected from the group consisting of alkyl acrylates, alkyl methacrylates, acrylamides, methacrylamides, vinyl acetate and sulfonic acid group-containing monomers and salts thereof.

* * * * *